US006848857B1

(12) United States Patent
McColl et al.

(10) Patent No.: US 6,848,857 B1
(45) Date of Patent: Feb. 1, 2005

(54) PROTECTION BARRIER SYSTEM

(75) Inventors: Richard G. McColl, Knoxville, TN (US); C Reed Davis, Knoxville, TN (US)

(73) Assignee: Safety Barriers, Inc., Knoxville, TN (US)

( * ) Notice: Subject to any disclaimer, the term of this patent is extended or adjusted under 35 U.S.C. 154(b) by 0 days.

(21) Appl. No.: 10/718,464

(22) Filed: Nov. 20, 2003

Related U.S. Application Data

(63) Continuation-in-part of application No. 10/339,237, filed on Jan. 9, 2003, now Pat. No. 6,669,402.

(51) Int. Cl.[7] ..... E01F 13/00
(52) U.S. Cl. ..... 404/6
(58) Field of Search ..... 404/6, 9, 10; 256/13.1; 403/119, 364

(56) References Cited

U.S. PATENT DOCUMENTS

| | | | | |
|---|---|---|---|---|
| 3,326,099 A | | 6/1967 | Cova et al. | |
| 3,952,453 A | | 4/1976 | Amburgey | |
| 4,681,302 A | | 7/1987 | Thompson | |
| 4,773,629 A | | 9/1988 | Yodock | |
| 4,869,617 A | | 9/1989 | Chiodo | |
| 4,946,306 A | | 8/1990 | Yodock | |
| 5,011,325 A | | 4/1991 | Antonioli | |
| 5,033,905 A | | 7/1991 | Schmidt et al. | |
| 5,104,254 A | | 4/1992 | Durand | |
| 5,104,255 A | | 4/1992 | Bodensohn | |
| 5,123,773 A | | 6/1992 | Yodock | |
| 5,149,224 A | * | 9/1992 | Smith | 404/6 |
| 5,208,585 A | | 5/1993 | Sprague | |
| 5,286,136 A | | 2/1994 | Mandish et al. | |
| 5,292,467 A | | 3/1994 | Mandish et al. | |
| 5,336,016 A | | 8/1994 | Baatz | |
| 5,387,049 A | | 2/1995 | Duckett | |
| 5,425,594 A | | 6/1995 | Krage et al. | |
| 5,480,255 A | | 1/1996 | Bernaquez et al. | |
| 5,498,101 A | | 3/1996 | Braverman | |
| 5,531,540 A | | 7/1996 | Wasserstrom et al. | |
| 5,611,641 A | | 3/1997 | Christensen | |
| 5,836,714 A | | 11/1998 | Christensen | |
| 5,860,762 A | * | 1/1999 | Nelson | 404/6 |
| 5,988,934 A | | 11/1999 | Wasserstrom | |
| D431,657 S | | 10/2000 | Wasserstrom | |
| 6,409,417 B1 | | 6/2002 | Muller et al. | |
| 6,767,158 B1 | * | 7/2004 | Consolazio et al. | 404/6 |

FOREIGN PATENT DOCUMENTS

| | | |
|---|---|---|
| FR | 2 685 021 A1 | 6/1993 |
| FR | 2 691 728 A1 | 12/1993 |
| WO | WO 93/12300 | 6/1993 |

* cited by examiner

*Primary Examiner*—Gary S. Hartmann
(74) *Attorney, Agent, or Firm*—Pitts & Brittian, P.C.

(57) ABSTRACT

A protection barrier system for energy-absorption of impacts includes an elongated barrier defining a chamber therein. The barrier includes side walls having a plurality of connected non-vertical wall segments and a plurality of buttresses positioned vertically at spaced apart locations along each side wall. One or more guide channels are positioned on each side wall in horizontal alignment with similar guide channels on like-configured barriers. A coupling is disposed on each opposed end of the barrier for coupling of either barrier end juxtaposed in end-to-end nested arrangement with like barriers. A supplemental energy-absorbing system is connectable between opposed ends of end-to-end coupled barriers, providing energy-absorbing tubes removably inserted through each guide channel of each barrier. Cables are extendable through the tubes in the guide channels of the nested barriers, providing additional energy-absorption and deterrence from breaching of the barriers. A method of manufacture for the protection barrier is also disclosed.

6 Claims, 14 Drawing Sheets

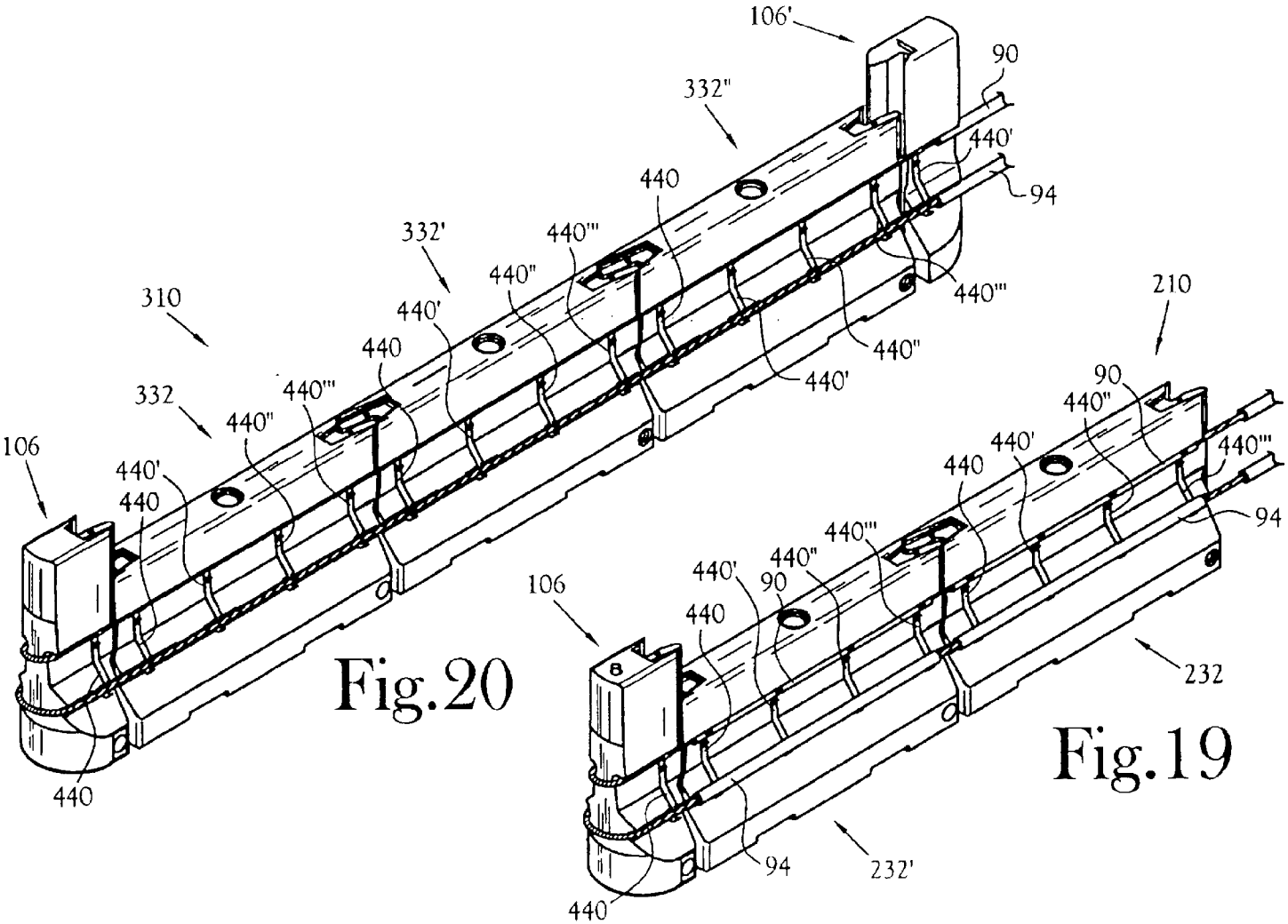
210
90
440'''
94
440''
440'
440
440'''
440''
90
440'
440
440'''
440''
440'
440
440'''
440''
440'
440
440'''
440''

PROTECTION BARRIER SYSTEM

CROSS REFERENCE TO RELATED APPLICATIONS

This Application is a continuation in part of application Ser. No. 10/339,237, filed Jan. 9, 2003 now U.S. Pat. No. 6,669,402.

STATEMENT REGARDING FEDERALLY SPONSORED RESEARCH OR DEVELOPMENT

Not Applicable

BACKGROUND OF THE INVENTION

1. Field of Invention

This invention pertains to temporary barriers utilized for channeling of vehicles and protection of workers along roads. More particularly, this invention pertains to movable energy-absorbing barriers having a plurality of configurations providing multiple levels of collision protection.

2. Description of the Related Art

Safety barriers are utilized along roadways and near building construction sites to channel vehicles past construction areas in order to minimize vehicle intrusion into worker occupied areas for protection of workers from vehicle impacts. Prior safety barriers typically include portable containers composed of semi-rigid plastic material formed into various shapes that are generally light-weight for transport between work sites, but can be filled with sand or water during use as a stationary barrier. Prior elongated safety barriers include end portions that are generally planar to allow end-to-end positioning of rectangular shaped barriers. A vehicle can penetrate through a line of prior safety barriers at any uncoupled end junction upon impact at or near the end junction, with a significant risk of intrusion into a worker occupied area.

A prior art safety barrier is illustrated in FIGS. 1–3, with the barrier including differently configured, opposed end surfaces that must mate with a second barrier end having a reversed configuration. The differently configured first end and second end surfaces of the prior art barriers typically require an end post or a locking pin to be manipulated through a second end slot or hole of a second barrier end. If the supporting surface is uneven, such as broken pavement, the first barrier end post or locking pin may not fit into an inadequately mated second end slot or hole. A vehicle impacting the prior art barriers positioned end-to-end can break through at the inadequately mated barrier ends without a significant amount of energy absorption by either end of the prior art barriers. Therefore, a vehicle can penetrate through the prior art barriers and into a worker occupied zone while retaining significant momentum.

A protection barrier system is needed that provides rapid assembly and disassembly of like-configured barrier ends, regardless of barrier length and without assembly disruption due to uneven supporting surfaces. There is a need for a protection barrier system that includes a barrier having side wall surfaces which distribute the force of a side impact along the side wall surfaces to minimize breaching of the barrier. A further need is a barrier system which supports a supplemental energy-absorbing system utilized with a plurality of like-configured nested barriers to provide energy-absorption and impact force distribution over numerous side wall surfaces of the plurality of like-configured nested barriers.

BRIEF SUMMARY OF THE INVENTION

According to one embodiment of the present invention, a protection barrier system is disclosed having a plurality of uses including channeling of vehicular traffic, providing energy-absorption and containment of vehicular impacts, controlling crowds, delineating parking areas, and providing a secure perimeter around buildings. The protection barrier system includes an elongated barrier defining a chamber therein. The barrier includes first and second side walls having a plurality of non-vertical wall segments disposed thereon. A plurality of buttresses are positioned vertically at spaced apart locations along each side wall. At least one guide channel is carried by each side wall, with the guide channel being positioned in horizontal alignment with similar guide channels on like-configured barriers. A like-configured coupling is disposed on each opposed end of the barrier, with the coupling for connecting of either barrier end juxtaposed in end-to-end arrangement with like-configured barriers. One embodiment of the side wall includes the plurality of non-vertical wall segments being connected to define a continuous side wall surface having an upper guide channel and a lower guide channel, with each guide channel disposed horizontally along each side wall surface. Each buttress includes an upper opening and a lower opening aligned with respective upper and lower guide channels of the side walls. The upper and lower guide channels provide improved energy-absorbing and impact force distribution for lateral channeling of a vehicle upon impact with the barrier. The like-configured coupling on each barrier end is removably coupled with a like-configured coupling on the first end or the second end of a similar configured barrier to provide end-to-end nesting of a selected length of similar configured barriers oriented in a straight or a curved orientation. A supplemental energy-absorbing system is detachably connectable between opposed ends of a plurality of end-to-end nested barriers. Aligned upper and lower tubes are removably insertable through each upper and lower guide channel of respective barrier side walls, and upper and lower cables are inserted through the tubes. The upper and lower cables are fixed at the opposed, non-nested ends of the barriers by connecting to end connector members that provide support and tension for each cable extended through the upper and lower tubes of end-to-end nested barriers. The energy of a vehicle impacting the barrier is absorbed by the side walls and the supplemental energy-absorbing system, thereby channeling a vehicle along respective side walls of nested barriers to deter a vehicle from passing over or breaching the coupled ends of the end-to-end nested barriers. A method of manufacture for the protection barrier is also disclosed herein.

BRIEF DESCRIPTION OF THE SEVERAL VIEWS OF THE DRAWINGS

The above-mentioned features of the invention will become more clearly understood from the following detailed description of the invention read together with the drawings in which:

FIG. 19 is a perspective view of a plurality of nested barriers of the alternative embodiment of the protection barrier of FIG. 18

FIG. 20 is a perspective view of an additional alternative embodiment of the protection barrier of FIG. 18, including a plurality of tubes guided by the plurality of spring clips;

DETAILED DESCRIPTION OF THE INVENTION

Figure 1:
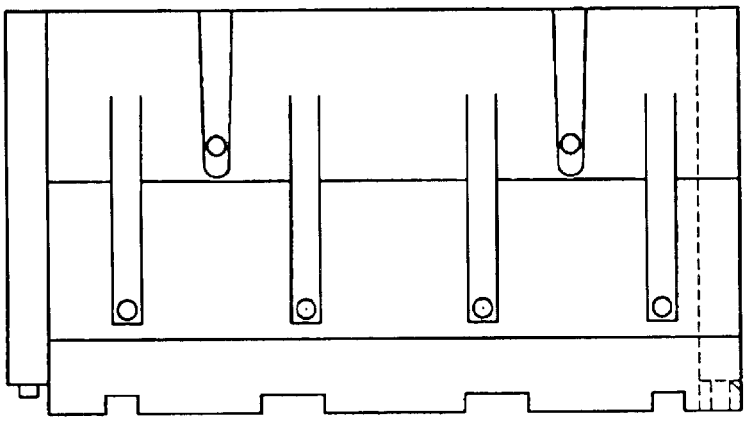
Fig.1 (PRIOR ART)
FIG. 1 is a side view of a prior art safety barrier.
Figure 2:
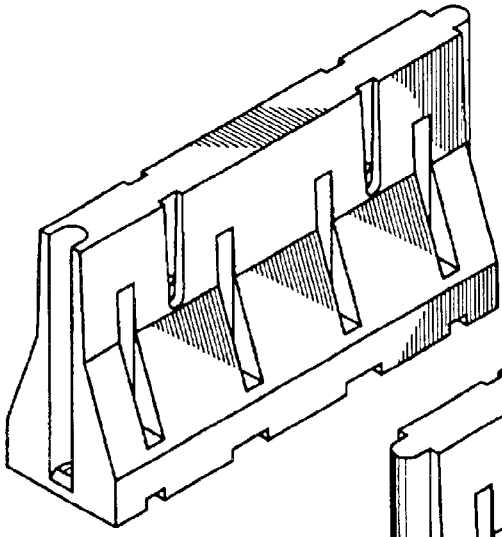
Fig.2 (PRIOR ART)
FIG. 2 is a perspective side view illustrating one end of the prior art safety barrier of FIG. 1.
Figure 3:
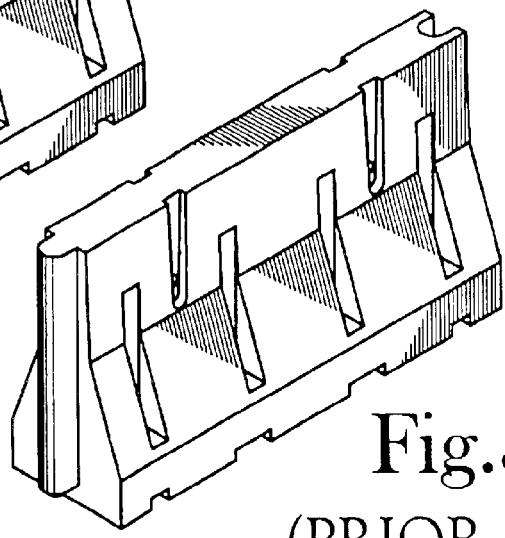
Fig.3 (PRIOR ART)
FIG. 3 is a perspective side view illustrating an opposed end of the prior art safety barrier of FIG. 1.
Figure 4:
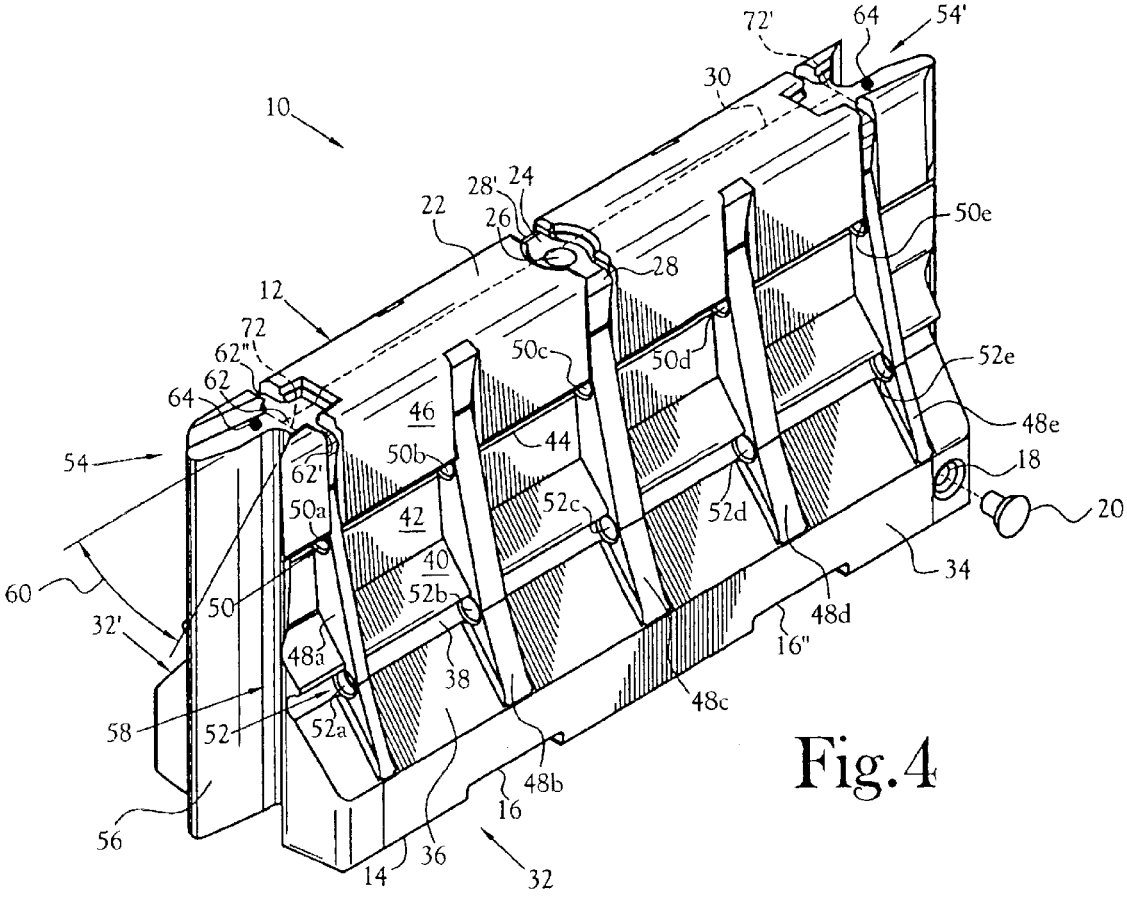
FIG. 4 is a perspective view of a protection barrier system of the present invention, illustrating one embodiment of a protection barrier.

A protection barrier system 10 is disclosed having a plurality of configurations to provide multiple levels of protection during use for channeling vehicular traffic, providing impact energy-absorption as roadway barriers, controlling crowds, delineating parking areas, and providing security around buildings. The protection barrier system 10 is illustrated in FIG. 4 and includes an elongated barrier 12 having a hollow interior 12' enclosed by a base 14, a top surface 22, a first side wall 32, a second side wall 32', a first end 54 and a like-configured second end 54'. The elongated barrier 12 is connectable end-to-end by nesting of either end 54, 54' with additional like-configured ends of similar configured protection barriers to form a plurality of barriers aligned in straight or curved orientations. The length of each barrier 12 can be increased during a production process to provide alternative lengths (see FIGS. 12 and 13) depending on the use. During assembly of a plurality of interconnected barriers, each protection barrier can be fortified with an impact reinforcement system having additional energy-absorbing members 80 that are removably insertable through either side wall or both side walls 32, 32' of each barrier 12 for use along rural roads, along highway work zones, and in dense traffic zones where frequent barrier impacts are anticipated.

Figure 8A:
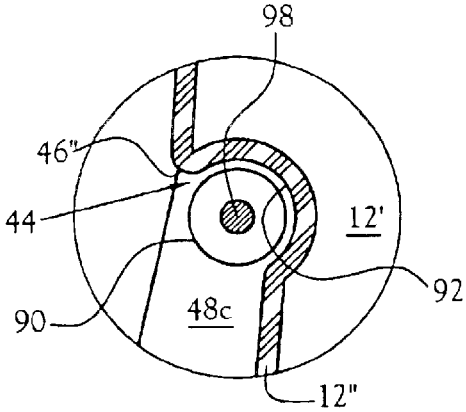
FIG. 8*a* is a detailed side view of an upper channel depicted in FIG. 7*a;*
Figure 8B:
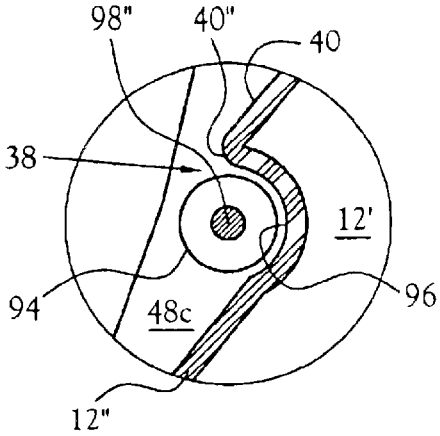
FIG. 8*b* is a detailed side view of a lower channel depicted in FIG. 7*a;*

One embodiment of the elongated barrier 12 includes a generally upright shape having a base 14 that is wider than the top surface 22. The outer walls of the barrier 12 are formed of a polyethylene material of selected thickness 12" (see FIGS. 8*a* and 8*b*) and density in order to provide a substantially rigid shape having an outer surface layer that is generally resistant to degradation from the weather. The barrier 12 provides an energy-absorbing barrier having an empty weight in a range of between about 50 pounds to about 200 pounds. The lower weight range for the barrier 12 is due to a polyethylene wall thickness of about 3/16 inch for each surface of the barrier 12. A barrier 12 having a lighter weight of about 50 pounds to about 100 pounds is utilized for controlling pedestrians, controlling crowds at public gatherings, and for delineating parking areas. The upper weight range is due to a polyethylene wall thickness of about ½ inch for each surface of the barrier 12. A barrier 12 having a heavier weight of greater than about 100 pounds is utilized for channeling vehicular traffic, providing impact energy-absorption as roadway barriers, and providing security around buildings. In order to meet and exceed the highway barrier certification standards provided by the National Highway Traffic Safety Administration (NHTSA) for speed zones of 42 mph or higher, one embodiment for the barrier 12 includes a polyethylene wall thickness of between about ¼ inch to about ¼ inch, and a height of about forty-two inches from the base 14 to the top surface 22. For additional uses such as crowd control, parking area delineation, building security barriers and/or police and fire security barriers, the height of alternative barriers can vary in a range from about thirty inches in height to about forty-eight inches in height. A standard width of the base 14 between the lower base segment 34 of the first side 32 and the opposed lower base segment 34' of the second side 32' is about twenty-four inches, with alternative embodiments having a base width in a range from about twenty inches to about thirty inches. An outer width of the top surface 22 is about ten inches to about twelve inches in width. Each upper side edge of the barrier 12 is rounded at about an inch radius in a preferred embodiment, therefore the substantially planar portion of the top surface 22 is about ten inches in width.

Figure 5:
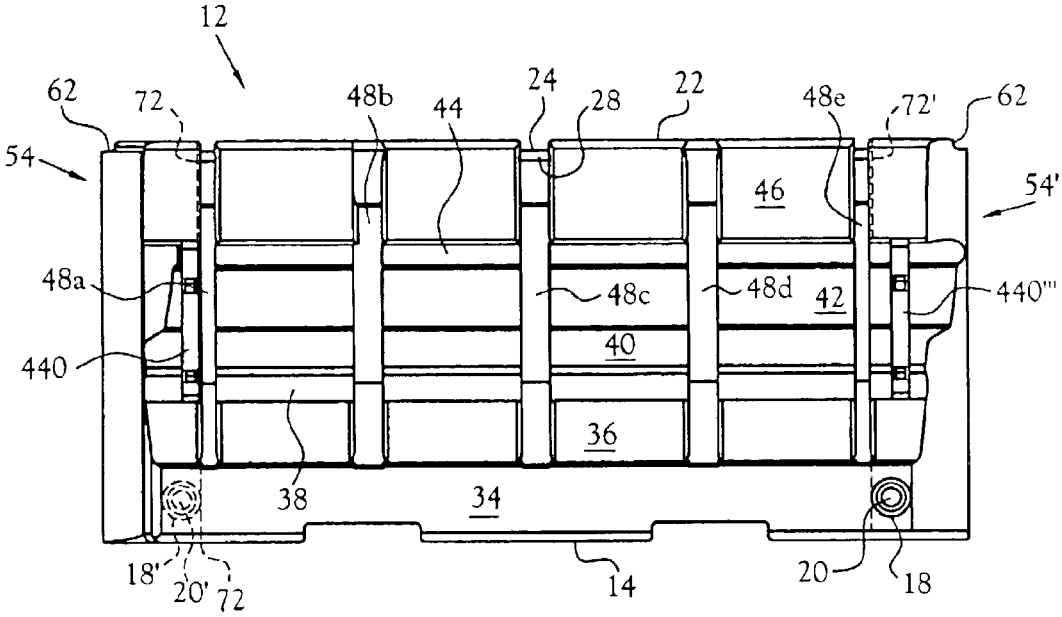
FIG. 5 is a side view of the protection barrier of FIG. 4, illustrating one embodiment of the side wall structure of the barrier.
Figure 6:
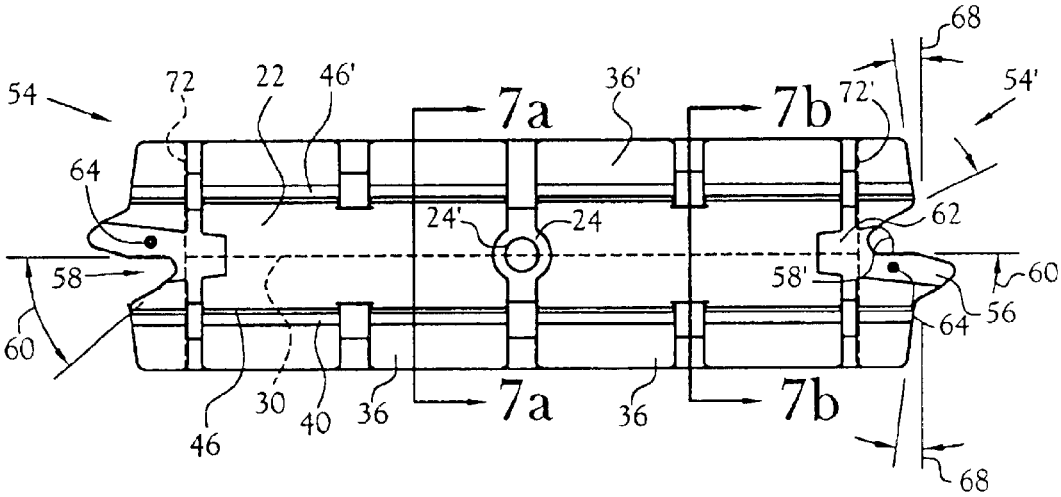
FIG. 6 is a top view of the protection barrier of FIG. 5, illustrating the FIG. 7*a* is a section view along 7*a*-7*a* of FIG. 6, illustrating a plurality of wall segments of the side wall surface of one embodiment of the barrier.

The barrier 12 illustrated in FIGS. 4–6 is formed by a rotational molding production process utilizing four segments of molded and shaped polyethylene material formed into two identical side walls 32, 32' that are joined along part line 30, and two like-configured ends 54, 54' that are joined at part lines 72, 72' at opposed ends of the joined side walls 32, 32'. An axial length of the hollow interior 12' between the base of the first end 54 and the second end 54' includes at least three alternative lengths for the barrier 12 depending on the use. A first length for the barrier 12 includes an overall length (OAL) of about seven feet, six inches (89.5 inches), and includes a nested length of about 81.25 inches when each end 54, 54' is connected to a like-configured end of similar configured barriers 110 (see FIG. 13). The first length is formed by the step of joining two identical side walls 32, 32', combined with a step of bonding identical ends 54, 54' to opposed ends of the side walls 32, 32'. A second length for a barrier 210 (see FIG. 19) includes an OAL of about thirteen feet, three inches, and a nested length of about twelve feet, six inches. The second length is formed by at least one step of joining two identical side wall sections 32, 32 end-to-end to form one side, repeating the step of joining for two identical side wall sections 32', 32' end-to-end to form the second side wall section, and a step of bonding identical ends 54, 54' to opposed ends of the side wall sections. A third length for the barrier 310 (see FIG. 20) includes an OAL of about nineteen feet, zero inches, and a nested length of about eighteen feet, four inches. The third length is formed by at least two steps of joining three identical side wall sections 32, 32, 32 end-to-end to form one side wall section, repeating the step of joining for three identical side wall sections 32', 32', 32' end-to-end to form the second side wall section, and a step of bonding identical ends 54, 54' to opposed ends of the side wall sections. The joining and bonding steps can be accomplished during molding by using heat, pressure, and/or adhesive compounds utilizing techniques for joining polyethylene materials or similar materials that are fluid when heated and become rigid when cooled as known to those skilled in the art.

The base 14 includes bottom surface features that facilitate the movement of each barrier 12 between sites of use without excessive wear on the polyethylene exterior surfaces. Two elongated slots 16, 16" originate in the lower base segment 34 and extend as channels through the lower surface of the base 14 to slots 16', 16'" (not shown) in the lower base segment 34' of the second side wall 32' (identical in FIG. 4 to first side wall 32). The width of each slot is sized to allow a pair of forks of a forklift to be inserted through and under the base 14 for lifting the barrier 12 to a preferred position along a roadway, or for lifting onto a truck for transport to a second location. In order to drain any ballast from the interior chamber or hollow interior 12', and to reduce the mass of the barrier 12 during transport, drain holes 18, 18' that are stoppered by replaceable plug 20 (see FIG. 4), and second plug 20' (see FIG. 5), are provided at opposed corners of the junction of the base 14 and each end 54, 54', as illustrated in FIGS. 4 and 5.

Figure 7A:
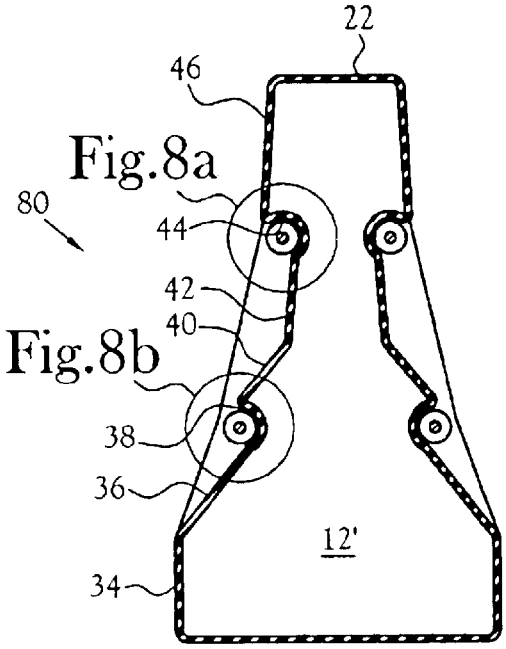
FIG. 7*b* is a section view along 7*b*-7*b* of FIG. 6, illustrating the relationship of a buttress of one embodiment and a plurality of channels on each side wall surface.
Figure 7B:
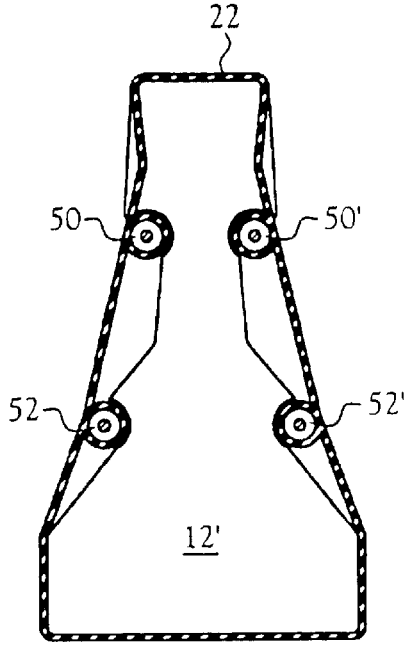

The barrier 12 is preferably formed out of polyethylene material by a method of manufacture and assembly, such as a rotational molding production method. In the preferred embodiment illustrated in FIGS. 7*a* and 7*b*, the thickness of each wall of the barrier 12 is about 5/16 inches. One embodiment includes a hollow interior cavity that extends through a lower portion of the barrier 12. A preferred embodiment provides a hollow interior cavity 12' that extends through a substantial portion of the lower and upper portions of the barrier 12 (see FIGS. 7*a* and 7*b*). The interior cavity 12' is substantially leak-tight for receiving and retaining liquid or granular ballast material such as liquid mixtures of water and anti-freezing agents, foam materials, or granular solids such as sand. The liquid or granular ballast material increases the mass of the barrier 12 to improve energy absorption of a vehicle impact, while maintaining the height of the center of gravity at a level of about 16.0 inches to about 16.7 inches above the bottom surface of the base 1 to minimize overturning of the barrier 12. The interior ballast, whether liquid, foam, or granular materials, is added through inlet 24' (see FIG. 6) disposed within the central indentation 24 on the top surface 22. Any liquids or granular materials exceeding the fill-volume are directed by indentation 24 to drain laterally along drain channel 28, 28' (see FIGS. 4–6). A removable plug 26 is provided to cover inlet 24' between additions of liquid, foam or granular ballast. The barrier 12 can be utilized without ballast materials therein for use in areas where low-energy impacts with barriers are expected along roads having speed limits of about 35 miles per hour or less. A preferred height of the center of gravity for a fluid filled barrier 12 is about 16.0 inches to about 16.7 inches above a bottom surface of the base 14. With the addition or draining of ballast, the height of the center of gravity of the barrier 12 can be adjusted depending on the anticipated need for energy absorption by barriers impacted by vehicles along roads where frequent vehicle impacts are anticipated.

In one embodiment of the barrier 12, both first side wall 32 and second side wall 32' have a similar configuration. For each side wall 32, 32', a plurality of non-vertical wall segments include a lower impact zone and an upper impact zone that are disposed between a lower base segment 34 that is vertically oriented above the base 14, and the rounded side edge of top surface 22. One skilled in the art will recognize that the dimensions of the preferred embodiment described herein for the side wall 32 can vary within a range of height dimensions that may be modified during the method of manufacture and assembly to meet the anticipated uses of each barrier. The preferred embodiment includes the lower base segment 34 extended from a rounded corner at the base 14 to a height of about 7.7 inches to about 8.0 inches above the base 14. The lower base segment 34 can be angled inwardly at a slight angle, or can be oriented generally vertical from the base 14. The lower impact zone includes a lower angled segment 36 extended from a connection with the lower base segment 34 at a height of about 7.7 inches to about 8.0 inches above the base 14, to connect with a lower portion of a curved lower guide channel 38 at a height of between about 14.6 inches to about 14.8 inches above the base 14. The inwardly oriented angle of the lower angled segment 36 is between about 40 degrees to about 50 degrees. An inwardly curved surface 96 of the lower guide channel 38 has a radius of between about 1.4 inches radius to about 1.5 inches radius. The center of the curved surface 96 and the lower guide channel 38 are between about 16 inches to about 16.2 inches above the base 14. The curved surface 96 is curved for a circumference that approximates a half circle (i.e. about 180 degrees along the inwardly curved surface 96)(see FIG. 8*b*). An upper boundary of guide channel 38, at a height of between about 17.5 inches to about 17.7 inches, is connected to a lower overhang 40" of a middle angled segment 40 that extends upwards at an inwardly oriented angle of between about 40 degrees to about 50 degrees. The lower impact zone is generally bounded by the lower overhang 40", and the curved surface 96 within channel 38, which are designed to be positioned at a height predicted to align the overhang 40" and lower guide channel 38 with the approximate height of the bumper of a small vehicle. The lower impact zone is positioned at the height of between 16 inches and 18 inches above the road surface for receiving of an initial impact from a bumper of a small vehicle to direct the vehicle laterally along the side wall 32 instead of up and over the barrier 12.

The upper impact zone includes the middle angled segment 40 connected with a middle sloped segment 42 at a height above the base 14 in a range of between about 22.0 inches to about 22.5 inches. The sloped segment 42 extends at an upwardly and inwardly oriented angle of between about 75 degrees to about 85 degrees. The middle sloped segment 42 connects at an upper end with a lower curved portion of an upper guide channel 44 at a height of between about 28.4 inches to about 28.7 inches above the base 14. The upper guide channel 44 includes upper curved surface 92 having a radius of between about 1.4 inches radius to about 1.5 inches radius that is about 30.0 inches to about 30.2 inches above the base 14. The upper portion of curved surface 92 and guide channel 44 is bounded by upper overhang 46", at a height of between about 31.4 inches to about 31.6 inches above the base 14. The upper boundary of curved surface 92 is extended for a circumference of about a half circle or greater than a half circle (i.e. about 180 degrees along the inwardly curved surface 92)(see FIG. 8*a*), from the lower curved portion of upper guide channel 44, to accentuate the upper overhang 46" extending laterally from upper sloped segment 46. The upper sloped segment 46 extends upwards and inwardly at an angle of between about 80 degrees to about 85 degrees to connect with the curved side edge of top surface 22 at a height of between about 41.0 inches to about 42.0 inches above the base 14. The upper guide channel 44 and upper overhang 46" are positioned at a height predicted to provide the guide channel 44 and overhang 46" as an upper boundary for an initial impact along the side wall 32 by a bumper of a large vehicle. Upper guide channel 44 and upper overhang 46" will preferably direct a large vehicle laterally along the side wall 32 instead of up and over the barrier 12. The barrier 12 provides improved work zone protection by the upper guide channel 44 engaging the bumper of a vehicle 102 during a side wall impact and the upper curved surface 92 restricting the bumper of a large or small vehicle from moving above overhang 46". The upper and lower impact zones of the side wall 32 channel a vehicle's impact in a lateral direction 102' along the barrier 12, therefore reducing the likelihood of a vehicle 102 moving over the barrier 12.

The plurality of non-vertical wall segments include wall segments having different angles and slopes 36, 40, 42, 46, and includes curved guide channels 38, 44, that provide a convoluted surface possessing a greater ability to absorb and dissipate energy from a side wall impact than previous straight wall barriers, or prior barriers having a single side wall curvature or having one angle for the side wall surface. The plurality of non-vertical wall segments of one embodiment of the protection barrier 12 (see FIG. 4), are connected end-to-end in water-tight connection to define side walls 32, 32' that are each upwardly angled as the plurality of wall segments extend from the base 14 to the top surface 22 of the barrier. The upwardly angled side walls 32, 32' extend from a wide base 14 and provide a barrier 12 having a low center of gravity when the interior chamber 12' is filled with liquid or granular ballast, allowing the barrier 12 to be preferably moved laterally during a side impact instead of being pushed over upon impact.

Additional rigidity for each side wall 32, 32' is provided by at least two buttresses 48*a*, 48*e* disposed vertically at spaced apart locations between the first end 54 and the second end 54'. A preferred embodiment, illustrated in FIGS. 4–6, includes five vertical buttresses 48*a*–48*e* disposed a spaced apart distance apart between the first end 54 and the second end 54'. Each buttress 48*a*–48*e* is formed during the production process to be positioned vertically at spaced apart locations along each side wall surface. The buttresses 48*a*–48*e* are extended laterally from each side wall surface so that the outer edge surface of each buttress (see FIGS. 7*a* and 7*b*) is generally disposed laterally outwards of the side wall surface along a mid-portion of the plurality of non-vertical wall segments including the surfaces extending from the lower angled segment 36 to the overhang 46" (see FIGS. 4, 5, 7*a* and 7*b*). The outer disposed buttresses 48*a*, 48*e* near to the opposed barrier ends 54, 54', have a width of about one and one-half inches. The inwardly disposed buttresses 48*b*–48*d* have a width of about three inches. In one embodiment, each vertical buttress includes at least one hole 50 therethrough. In the embodiment illustrated in FIG. 4, each respective buttress includes holes 50*a*–50*e* horizontally aligned a selected distance above the base 14. In the embodiment illustrated in FIGS. 4, 5 and 7*a*–8*b* and 13, two sets of holes are disposed through each buttress. An upper hole 50 and a lower hole 52 are positioned respectively through an upper portion and a lower portion of each buttress for each side wall 32, 32'. The respective upper holes 50 are aligned horizontally along the upper guide channel 44 of each side wall 32, 32'. The lower holes 52 are aligned horizontally along the lower guide channel 38 of each side wall 32, 32'. For additional side wall rigidity, an adequately sized tube 90 is removably inserted through each upper hole 50 and upper guide channel 44 (see FIGS. 8*a* and 13). A similar adequately sized tube 94 is removably inserted through each lower hole 52 and the lower guide channel 38 (see FIGS. 8*b* and 13). The upper tube 90 and lower tube 94 remain horizontally aligned through each respective buttress 48*a*–48*e*, providing supplemental energy-absorption during an impact by a vehicle 102 against each side wall 32, 32' as discussed further herein.

The barrier 12 includes each end 54, 54' including a coupling having elements providing interconnection means for connecting a plurality of like-configured barriers end-to-end. The elements of the coupling are disposed on each opposed barrier end to form the barrier ends 54, 54' joined along respective part lines 72, 72' to each end portion of like-configured side walls 32, 32'. The elements for the coupling provide interconnection means for releasably interlocking either like-configured end 54, 54' of a first barrier 12 with either like-configured end 54 or 54' of a similar configured barriers 12 (see FIG. 13). A plurality of like-configured barriers 12 can be releasably mated together in end-to-end alignment to provide barriers positioned along a roadside in generally straight orientation and/or positioned in a curved orientation 110 (see FIGS. 13, 17 and 20). The like-configured ends 54, 54' are mirror configurations and allow rapid coupling by mating ends 54, 54', or ends 54, 54 of like-configured barriers 12 without assembly disruption due to uneven supporting roadway surfaces.

Figure 9:
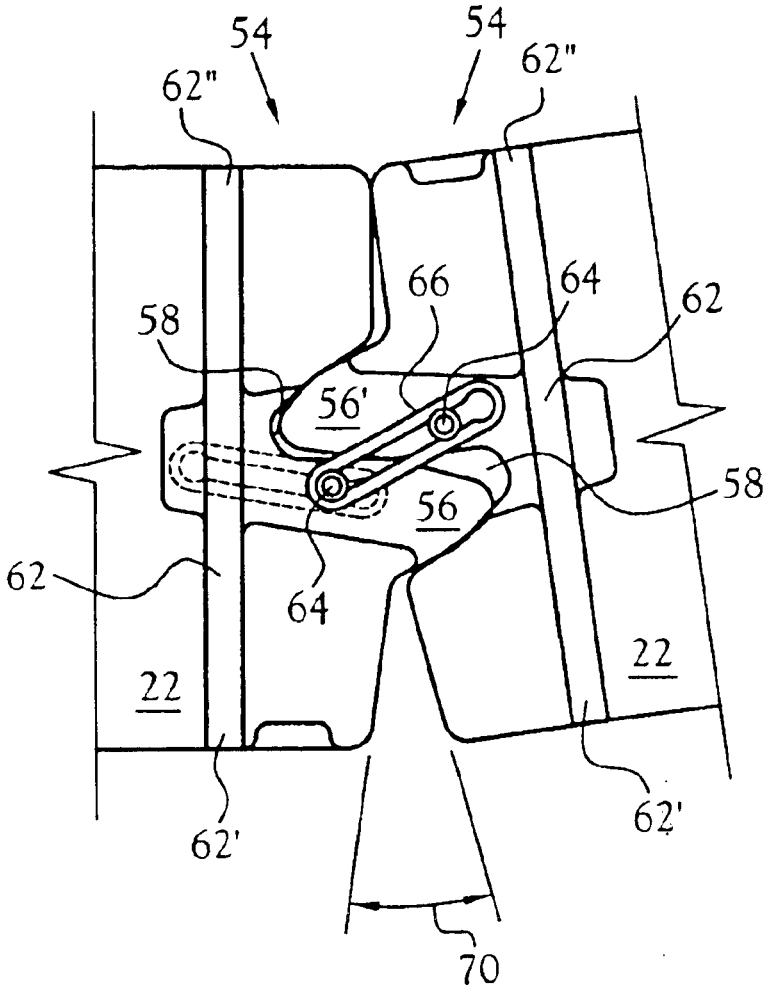
FIG. 9 is a top view of the ends of two barriers nested end-to-end.
Figure 11:
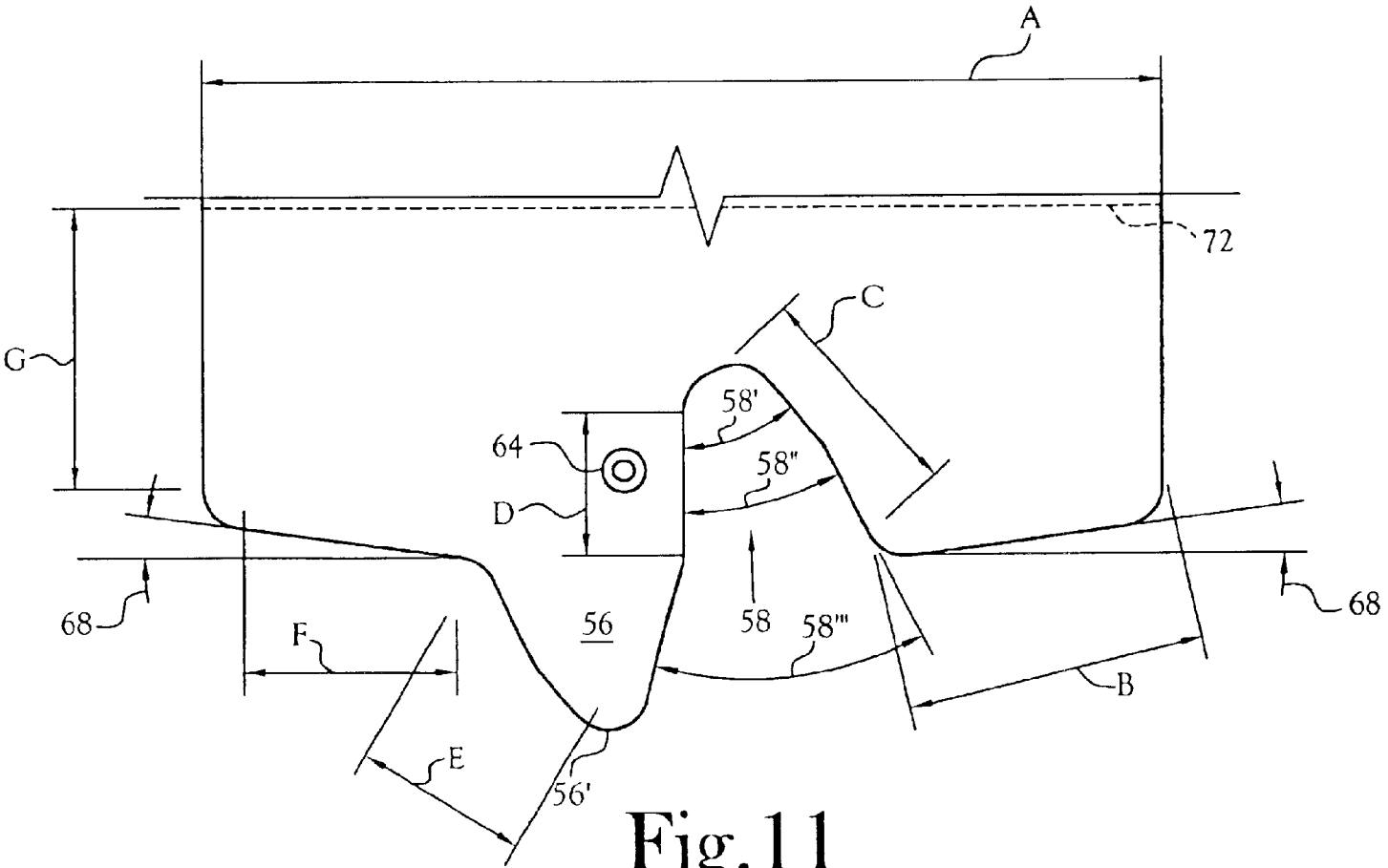
FIG. 11 is a top view of one end of a barrier depicted in FIG. 4.

One component of the coupling includes a receiving channel or groove 58 that extends vertically within each end 54, 54' (see FIGS. 9 and 11). The groove 58 can extend either a partial distance from the base 14 to approximately a mid-portion of the ends 54, 54', or the groove 58 can extend along an upper portion of each end 54, 54' from the mid-section to approximately the top surface 22. A preferred embodiment for the groove 58 includes a vertical extension along substantially the full height of each end from the base 14 to an end channel 62 recessed in each upper end of the top surface 22 (see FIG. 4). A second component of the coupling includes a tongue 56 protruding from each end 54, 54' at a distance F of about 5.6 inches from one corner of each end 54, 54'. The distance E of protrusion from each end 54, 54' is about 3.7 inches along an outwardly faced curved surface extended to a tongue end 56'. The tongue 56 also protrudes about 3.5 inches along an inner faced curved surface from the opening 60 of the groove 58. The inner faced curved surface of tongue 56 is contiguous with an inner portion of the groove 58, forming an inner side boundary of the groove 58. The tongue 56 and the adjacent groove 58 extend vertically from the base 14 to the end channel 62 in the top surface 22. An end width JA is about 24 inches for each top portion of each end 54, 54', as measured across each end channel 62 (see FIGS. 9 and 11). Distance 0 of about 4.2 inches forms the depth of each corner of each end 54, 54' from respective part lines 72, 72' (see FIG. 11).

Figure 17:
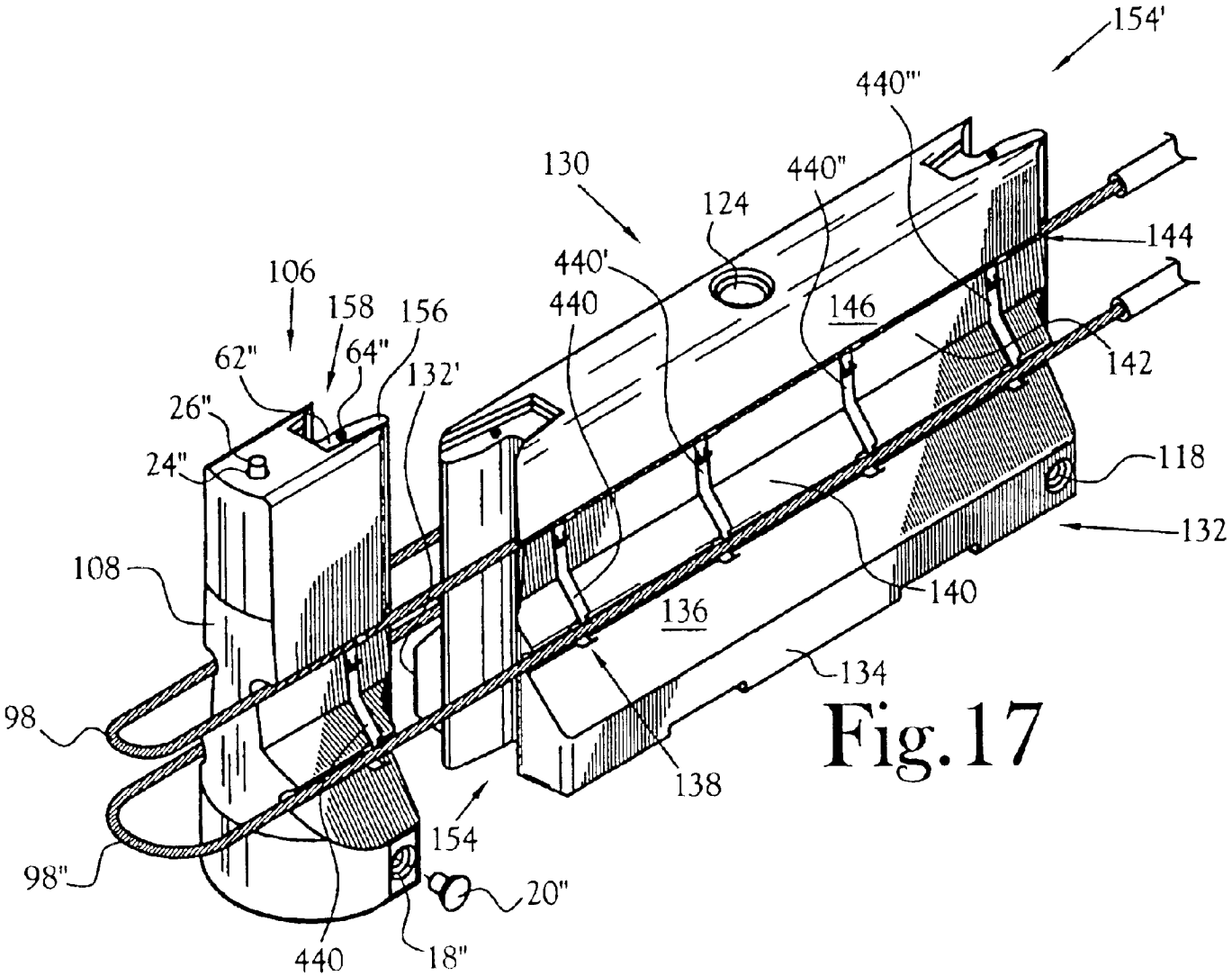
FIG. 17 is a perspective view of an additional alternative embodiment of the barrier and end connector of FIG. 14, including an end member and a plurality of spring clips positioned to guide the cables of the supplemental energy-absorbing system.
Figure 18:
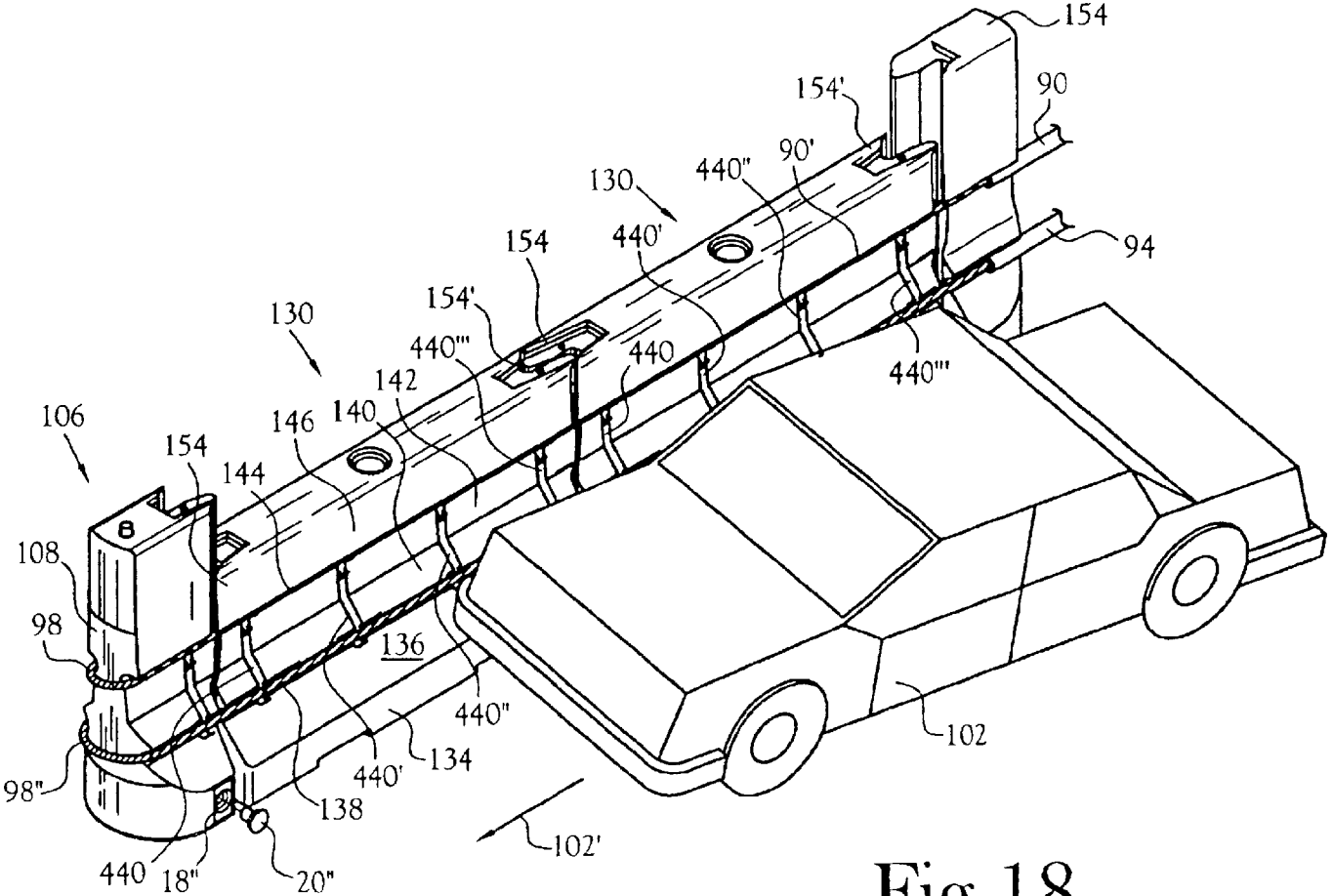
FIG. 18 is a perspective view of the barrier and end member of FIG. 17, illustrating a plurality of protection barriers connected end-to-end and having the energy-absorbing system attached to each side wall guide channel to channel a vehicle laterally along the length of the side walls of end-to-end nested protection barriers.

The protrusion end 56' of the tongue 56 is shaped to mate in engaging relationship with a groove 58 of a like-configured barrier end 54, 54' in end-to-end orientation of two or more nested barriers 110 (see FIGS. 9 and 17). The groove 58 is generally a rounded "V" shape that includes first side C of about 4.7 inches in length, and second side D of about 3.5 inches in length (see FIG. 11). The first side C and second side D of each groove 58 are non-linear and have changing or involute curvatures providing angles of separation which vary for each of an inner portion 58', a middle portion 58", and an outer portion 58'". When viewed in cross-section, as illustrated in FIG. 11, the opposed side segments of the groove inner portion 58' have an angle of separation between about 41 degrees to about 42 degrees. The opposed side segments of the groove middle portion 58" have an angle of separation between about 27 degrees to about 28 degrees. The opposed side segments of the groove outer portion 58'" have an angle of separation 60 (see FIG. 6) of between about 42 degrees to about 43 degrees. The various angles of separation for the groove 58 allow the insertion end 56' of a tongue 56 having an angled width of about 27 degrees or less to be releasably nested into the inner portion 58' of the groove 58 of either end 54, 54' of a second barrier 12. A first outer corner of groove 58 is disposed a width B of about 5.5 inches inwardly from one outer corner of the end 54. The outer angled surface of tongue 56 is disposed a width F of about 5.6 inches from the second outer corner of the end 54 (see FIG. 11).

Figure 21:
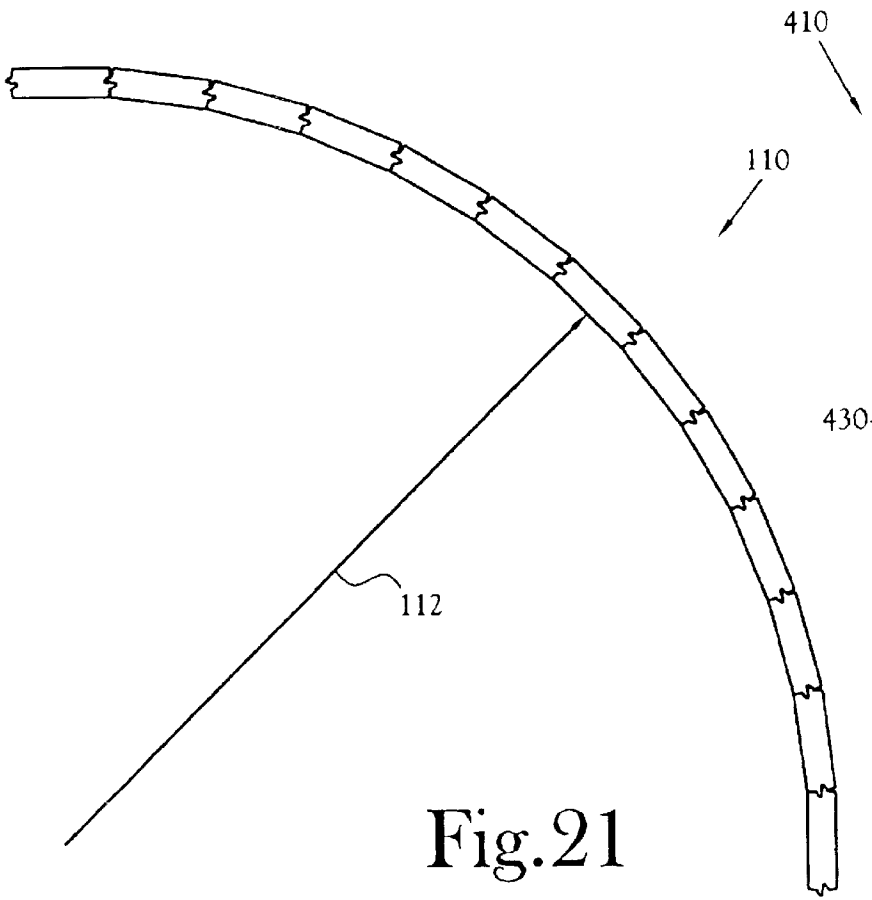
FIG. 21 is a perspective view of a plurality of like-configured barriers connected in a curved orientation.

Each opposed outer corner of each end 54, 54' are complementary edges disposed in angled configuration to permit hinged movement of each end 54, 54' when nested together. Each outer corner of respective nested barriers includes a beveled edge having an angle 68 of about 7.5 degrees less than a generally squared corner. An alternative embodiment for each opposed outer corner of each end 54, 54' can include a beveled surface having an alternative angle selected from a range of angles of about 7.5 degrees to about 15 degrees less than a generally squared corner. Upon insertion of tongue 56 of a first barrier end 54 into a groove 58 of a second barrier end, the angles 68 of each beveled edge of ends 54, 54' provide for pivotable movement 76 of the tongue 56 of one barrier end 54 relative to a groove 58 of a second barrier end 54 or 54'. The beveled corners of each end 54, 54' provide for pivotable movement 70 of about 7.5 degrees to about 15 degrees of pivoting movement for the barrier end 54 relative to the second barrier end 54 or 54' when nested end-to-end. The range of pivotable movement 70 (see FIG. 9) of about 7.5 degrees to about 15 degrees of pivoting movement for coupled, barrier ends will allow about thirteen barriers (see FIG. 21), to form a ninety degree change of direction having a radius 112 varying on the nested length of each individual barrier (see FIGS. 4, 18–21).

Figure 10:
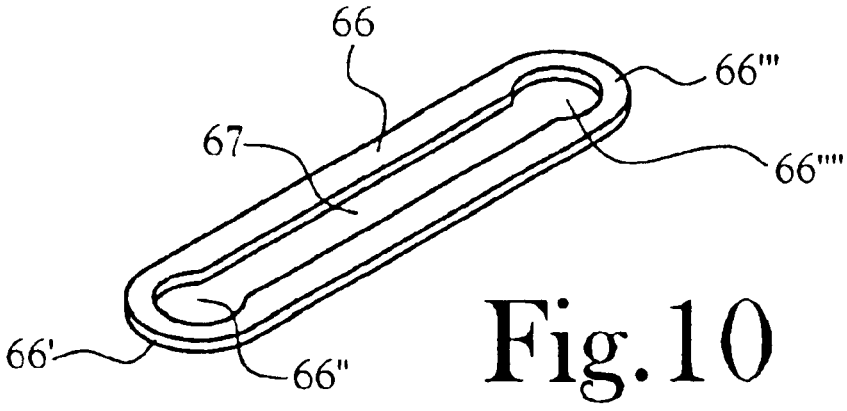
FIG. 10 is a perspective view of an end connector depicted in FIG. 9.

As illustrated in FIG. 9, the nested barrier ends 54 and 54, or barrier ends 54 and 54', are maintained in an interconnected, nesting relationship while allowing for a degree of pivotable movement 70. A nesting relationship of a tongue 56 of a first barrier end 54 is retained in a coupled, nesting relationship in a groove 58 of a second barrier end 54 by removably attaching an end connector member 66 having a single keyhole end (not shown), or preferably having double keyhole openings in opposed ends of an elongated slot 67 (see FIG. 10). A first keyhole opening 66" is defined within a rounded first connector end 66'. A second keyhole opening 66' ' is defined within a rounded second connector end 66'". When two or more barriers are nested end-to-end, the first keyhole opening 66" of the first connector end 66' is pivotably disposed on a channel post 64 of the first barrier end 54. The width of elongated slot 67 is approximately the width of a base diameter of the channel post 64. Each channel post 64 includes an outer flanged end having an outer diameter that is less than the diameter of either first keyhole opening 66" and second keyhole opening 66' ", but the channel post outer diameter is greater than the width of elongated slot 67. The second keyhole opening 66'" of the second connector end 66' is pivotably disposed on a channel post 64 of a like-configured second barrier end 54 or 54'. Upon placement of the end connector member 66 around respective channel posts 64, 64 of nested barrier ends 54, 54', a range of pivotable movement 70 is allowed for the movement of tongue 56 in groove 58 without each barrier end 54, 54' becoming disengaged. The end connector member 66 is composed of polyethylene material, a metal, or a comparable rigid material that retains its shape when the barrier ends 54, 54' are pivotably moved within a range of pivotable movement 70 for each pair of nested barrier ends (see FIG. 9). When the barrier ends 54, 54' are not nested together, the end connector member 66 is pivotable within the end channel 62 of either barrier end 54 or 54' and is retractable toward either channel drain indentation 62', 62" (see phantom depiction for connector member 66 in FIG. 9).

Figure 13:
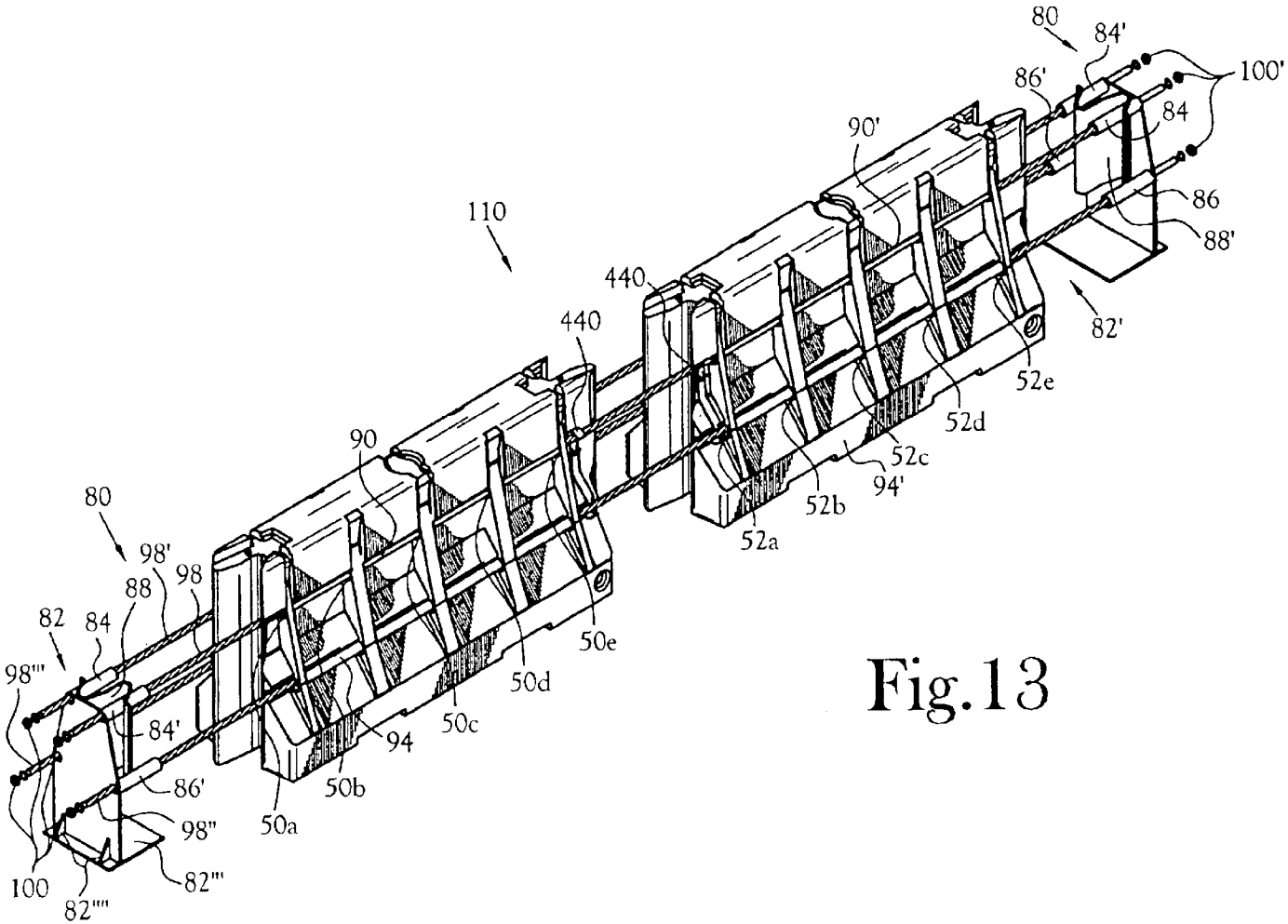
FIG. 13 is a perspective view of one embodiment of protection barriers connectable end-to-end and having a supplemental energy-absorbing system attachable thereto.
Figure 14:
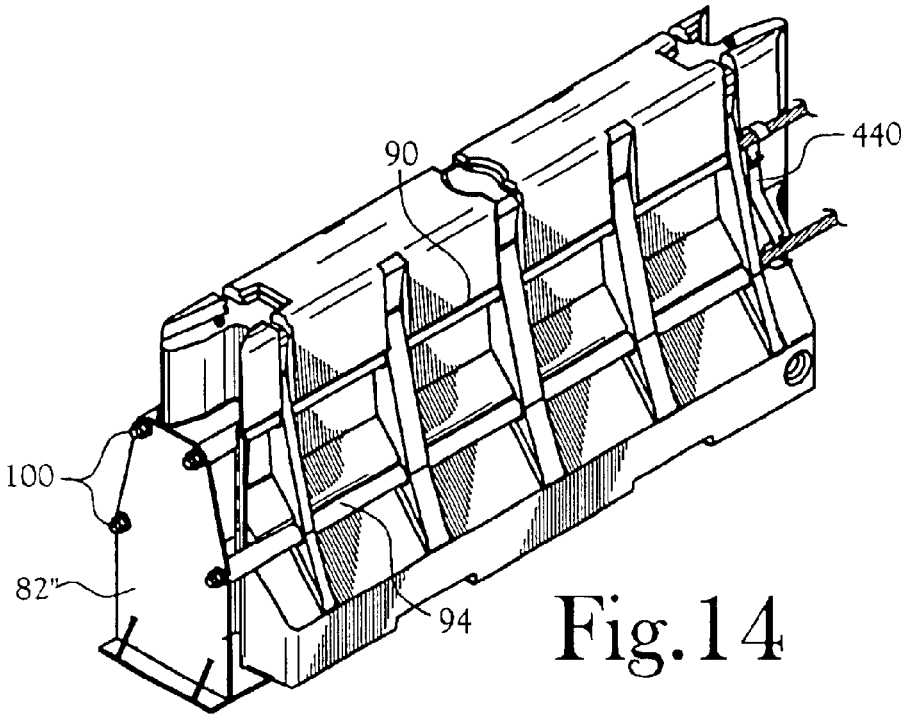
FIG. 14 is a perspective view of an end connector attached to cables of the supplemental energy-absorbing system depicted in FIG. 13.
Figure 15:
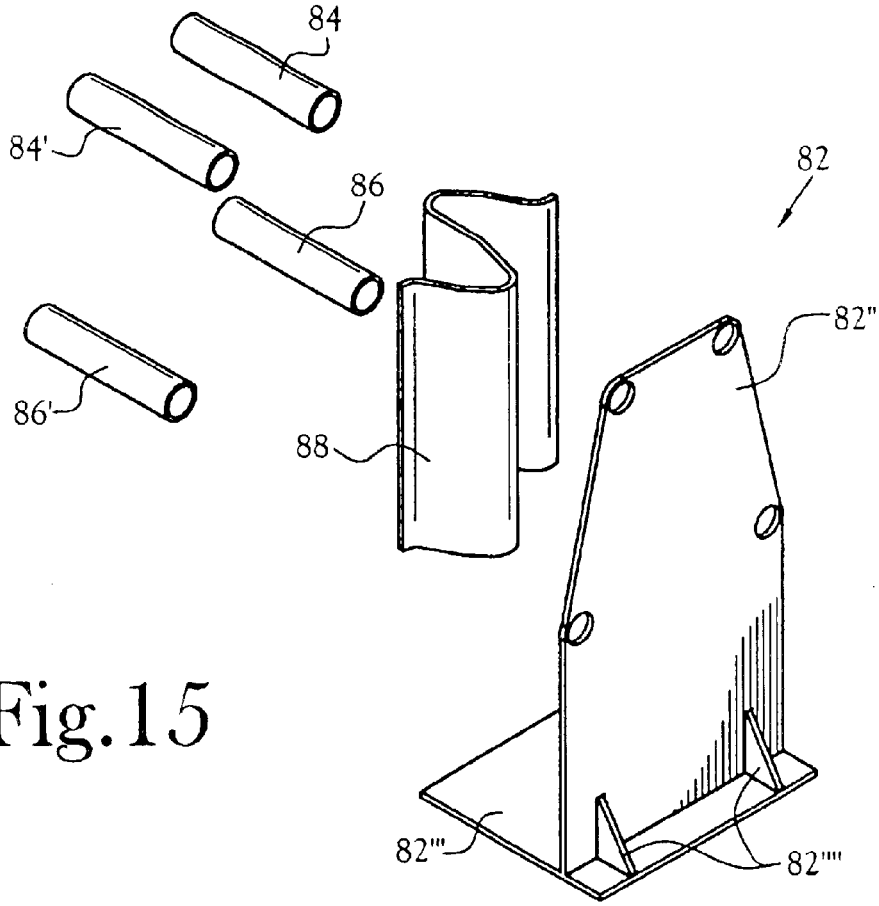
FIG. 15 is an exploded view of the end connector of FIG. 14.

One embodiment of the protection barrier system 10 is illustrated in FIGS. 13–15, providing for the addition of a supplemental energy-absorbing system 80 to one or more nested barriers 110 that are aligned end-to-end. The energy-absorbing system 80 includes members that are extended through respective guide channels 38, 44 and holes 50, 52 in either or both sides 32, 32' of the nested barriers 110 (see FIGS. 13 and 14). Installation of the energy-absorbing system 80 provides the nested barriers 110 with additional energy-adsorbing capabilities and improved means for distributing impact forces along the side wall 32 or 32' upon impact by any of a variety of vehicle sizes and shapes.

Figure 12:
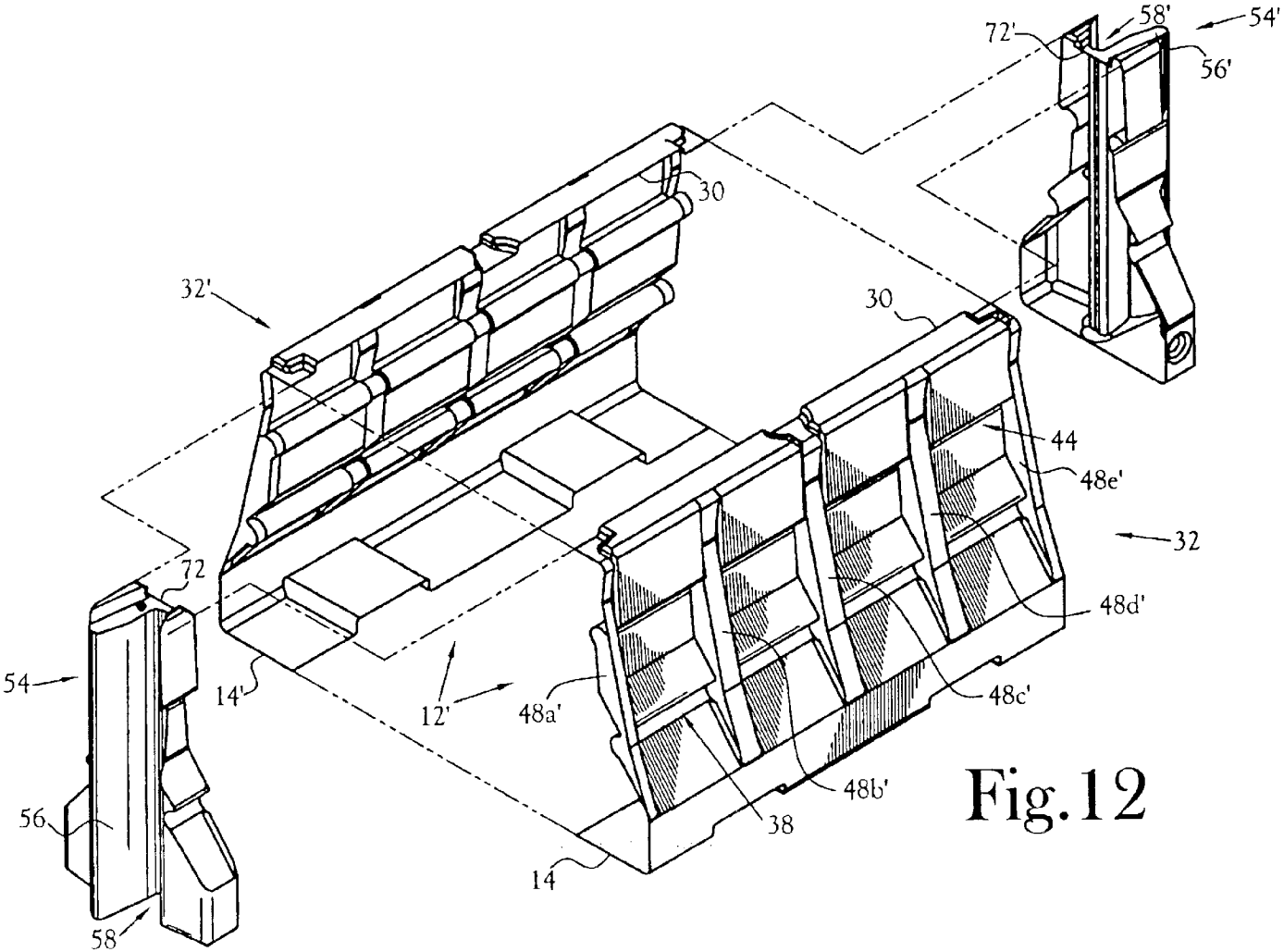
FIG. 12 is an exploded view of a an alternative embodiment of the barrier depicted in FIG. 4.

An alternative embodiment for the barrier 12 is illustrated in FIG. 17, depicting an alternative barrier 130 having a plurality of non-vertical wall segments 132, 132' disposed along the opposed wall surfaces, but without the plurality of buttresses formed into each side wall surfaces. Each side wall surface includes: a lower base segment 134, a lower angled segment 136, a lower guide channel 138, a middle angled segment 140, a middle sloped segment 142, an upper guide channel 144, and an upper sloped segment 146. The barrier 130 includes opposed wall surfaces without buttresses thereon for use in controlling pedestrians, controlling crowds at public gatherings, for delineating parking areas, and for roadside uses where speeds are typically less than about 35 mph. The barrier 130 can be filled with liquid or granular ballast disposed through an access port 124 (cover not shown), and drained from a drain hole 118 (plug not shown). The barrier 130 can be utilized without ballast therein to provide a light-weight, easily positioned barrier. The barrier 130 includes opposed ends 154, 154' with couplings having a tongue protrusion 156 and a groove 158 that allow either end 154, 154' to be coupled in end-to-end nested configuration with either end 154, 154' of a like-configured barrier 130 (without side wall buttresses), or with either end 54, 54' of barrier 110 (having side wall buttresses). Another alternative barrier includes a barrier configured as illustrated in FIG. 12, with two or more side wall buttresses 48*a*', 48*b*', 48*c*', 48*d*', 48*e*' on each side 32, 32', but without an upper hole 50 or a lower hole 52 through each buttress. The alternative barrier, lacking upper holes 50 or lower holes 52 in each buttress, is coupled end-to-end with like-configured ends of similar barriers, but without cables or tubes extended through each respective barrier side wall. The alternative barrier is utilized by positioning a plurality of the barriers having side wall buttresses but lacking holes therein, in coupled end-to-end orientation adjacent and parallel to, either in front of or behind, similar barriers with side wall buttresses, or lacking side wall buttresses thereon, to provide a plurality of barrier layers for impact absorption without cables or tubes extended through the barrier side walls.

Figure 16:
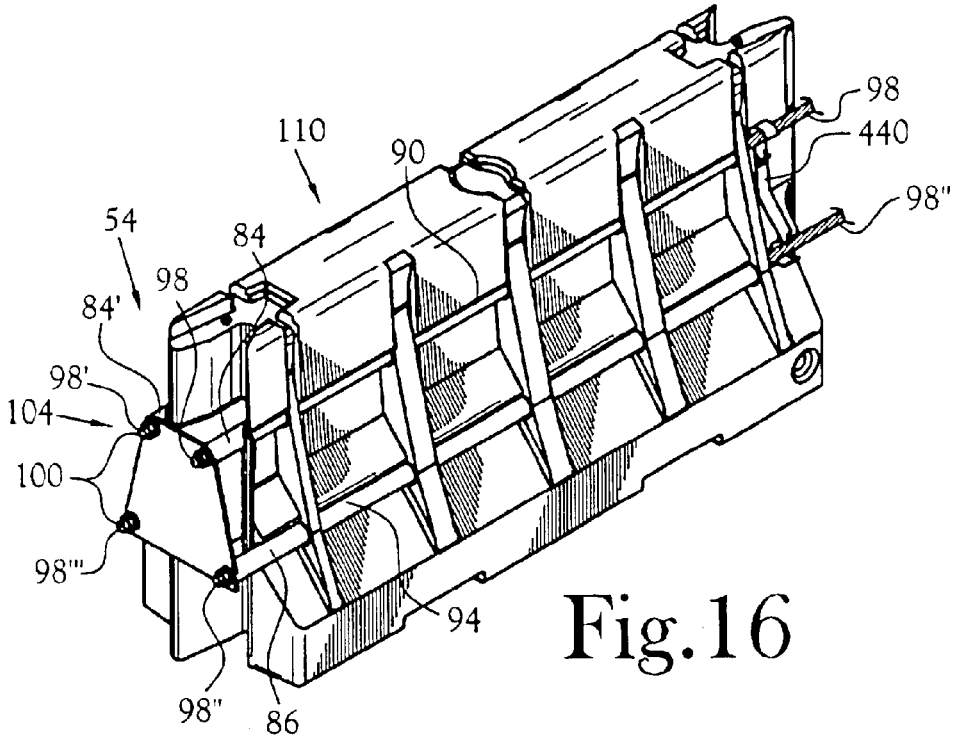
FIG. 16 is a perspective view of an alternative embodiment of the end connector of FIG. 15 and having spring clips positioned to guide the cables of the supplemental energy-absorbing system.
Figure 23:
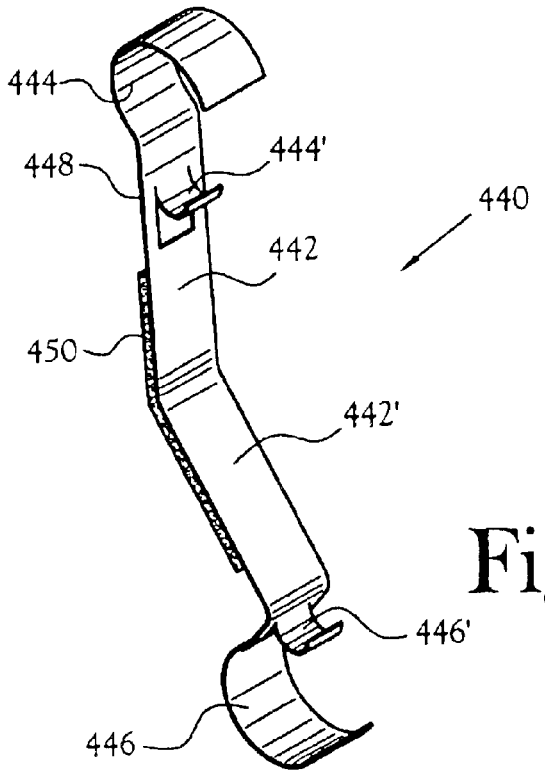
FIG. 23 is a perspective view of a spring clip utilized for positioning of cables and/or tubes through respective side wall guide channels of either protection barrier of FIGS. 16, 17 or 22.

As illustrated in FIG. 13, the energy-absorbing system 80 includes a pair of end connector brackets 82, 82', also identified as an end bridle members 82, 82', that provide a connector bracket and anchor for a plurality of cable ends that are extended through respective guide channels 38, 44 and holes 50, 52 in each barrier of the end-to-end nested barriers 110. The first end bridle member 82 is positioned at one, non-nested end 54 of a plurality of nested barriers 110. A second, like-configured, end connector bracket 82' is positioned at a distal, second non-nested end 54' of the plurality of nested barriers 110. The end bridle members 82, 82' are configured as identical connector members composed of metal and including upper guide conduits 84, 84' and lower guide conduits 86, 86' extending laterally from the support member 82" (see FIG. 15). An arcuate plate 88 or 88' is positioned against respective end bridle members 82, 82'. The arcuate plate 88 or 88' is composed of rigid polyethylene or metal and is disposed between the end bridle members 82, 82' and each respective tongue 56 and groove 58 of the opposed and unconnected ends 54, 54' of the plurality of end-to-end nested barriers 110. In one embodiment of the end bridle member 82, a generally horizontal base plate 82" is attached at the lower edge of the generally vertical support member 82" (see FIG. 15), to serve as a stand positioned on a supporting surface for each end bridle member 82, 82'. The generally horizontal base plate 82'" includes a base plate extension disposed on an opposed side of the generally vertical support member 82", with the base plate extension having two triangular supports 82' " joined against the generally vertical support member 82" and the generally horizontal base plate 82'". An alternative embodiment of an end bridle member 104 (see FIG. 16), does not include a base plate and is connected in a suspended position against respective barrier ends 54, 54'.

An alternative embodiment for an end connector is illustrated in FIG. 17, including an end member 106 that is generally hemispherical in shape and is positioned at opposed ends 154, 154' of a plurality of end-to-end aligned nested barriers 130. The end member 106 is composed of polyethylene materials and includes an interior chamber that can be filled with liquid or granular ballast. Each side wall portion of the end member 106 includes a plurality of non-vertical wall segments disposed at heights comparable to the like-configured side walls 132, 132' of nested barriers 130 (see FIG. 17). A ballast fill means includes an access hole 24" and removable plug 26" disposed in the top surface and a drain hole 18" and removable plug 20" are disposed in a lower segment of the outer curved portion 106" of the end member 106. The end member 106 includes a base having a width of about 24 inches, and a height selected from a range of heights of about 42 inches to about 72 inches from the base to the top of the end member 106. The top of the end member 106 includes a channel indentation 62"" having channel post 64" disposed therein for connecting of end connector member 66 thereto, for an end member 106 having a height of about the height of the barrier ends 154, 154'. An inwardly oriented arcuate side 106' of the end member 106 includes a groove indentation 56 and groove 58 (see FIG. 17) configured to fit into the tongue protrusion 56 and the groove 58 of either like-configured end 154, 154' of the opposed, non-nested ends of a plurality of nested barriers 130. An outer curved plate 108 is disposed along the outer curved portion 106" between an upper guide channel and a lower guide channel to provide a support to allow the respective upper cable 98 and a lower cable 98" to wrap around the outer curved plate 108 and the outer curved portion 106". The end member 106 provides an end connector that is highly visible for heights of about 46 inches to about 72 inches. The end member 106 also provides an additional reservoir for liquid or granular ballast when the interior of the end member 106 is filled with ballast upon positioning at the opposed, non-nested ends 154, 154' of a plurality of end-to-end aligned and nested barriers 130.

Figure 22:
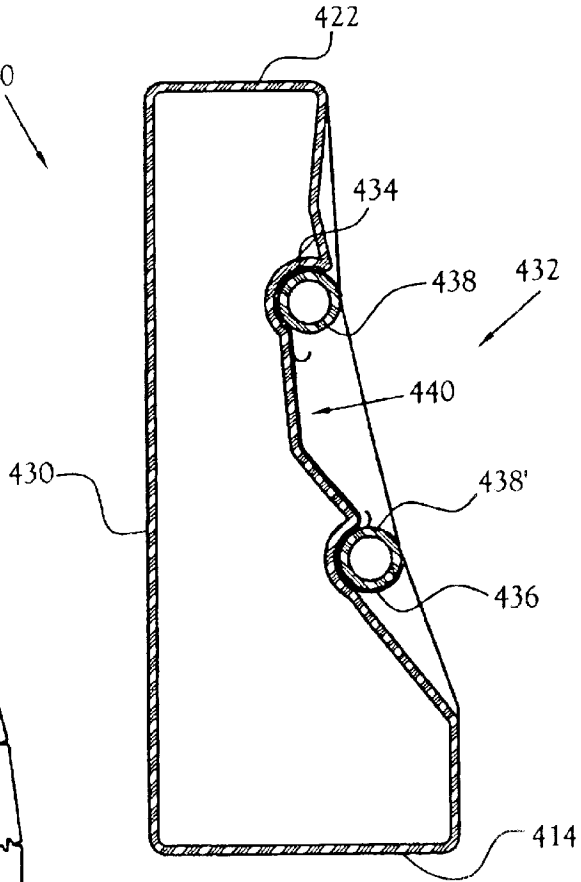
FIG. 22 is an end view of an additional embodiment of the protection barrier of FIG. 17.

For the protective barriers illustrated in FIGS. 17 and 22, a means for guiding is needed to expedite positioning, guiding, and retaining upper and lower cables and/or a plurality of tubes inserted through the respecting upper and lower channels of each barrier 130 or 410 of a plurality of nested barriers being assembled along a roadway or a racetrack. The means for guiding includes a plurality of spring clips 440, 440', 440", 440'" composed of metal and bent to include a curvature matching the barrier side wall outer surface extending from the lower guide channel 138, the middle angled segment 140, the middle sloped segment 142, and the upper guide channel 144. Each spring clip 440 includes an upper clip body 442 positioned against a portion of middle sloped segment 142, and an angled lower clip body 442' positioned against a portion of middle angled segment 140. The spring clip 440 includes a width of about one and a half inches to about two inches, and includes a back surface 448 having an adhesive pad 450 thereon, or includes a surface on which adhesive can be readily applied for retaining the back surface 448 against the barrier side wall outer surface. An upper clip segment 444 is curved to fit into and be retained within upper guide channel 144. The upper clip segment 444 includes an upper retainer spring 444' on which a tube and/or a tensioned cable can be positioned in preparation of inserting the tube and/or cable into upper clip segment 444 retained within the inwardly curved upper guide channel 144. A lower clip segment 446 includes a lower retainer spring 446' on which a tube and/or a tensioned cable can be positioned in preparation of inserting the tube and/or a tensioned cable into lower clip segment 446 retained within the inwardly curved lower guide channel 138 of a barrier 130 or 410. A plurality of spring clips 440, 440', 440", 440'" are spaced apart and vertically aligned along respective side walls to expedite guiding, and retaining upper and lower cables and/or a plurality of tubes inserted through the respecting upper and lower channels of each barrier 130 or 410 of a plurality of nested barriers. An additional use of one or more of the spring clips 440 includes positioning a spring clip 440 against the side surfaces of the connecting ends of barriers having side wall buttresses, when the barriers are coupled in end-to-end nesting relationship, to provide means for guiding upper and lower cables and/or a plurality of tubes inserted through each respective upper and lower channel of the barriers (see FIGS. 13, 14, 16). At least two spring clips 440, 440' can be also positioned at appropriate heights on respective first and second end members 106, 106' on opposed ends of a plurality of nested like-configured barriers (see FIG. 20).

For each side wall 32, 32' of the nested barriers 110, an upper tube 90 of a rigid material such as metal, or preferably a PVC pipe of about 0.187 inch to about 0.218 inch wall thickness, is removably insertable through the aligned upper holes 50. The upper tube 90 is guided along the upper guide channel 44 created by the overhand 46" of the upper wall segment 46. The energy-absorbing system 80 includes at least two upper cables 98, 98' composed of high-strength stranded metal wire. The upper cable 98, 98' are extended through the upper tubes 90 on each side wall 32, 32' of aligned barriers. The cable ends are threaded through the respective upper guides 84, 84' of the first end bridle member 82 and second end bridle member 82', and the cable ends are secured on the outer surface of the generally vertical support member 82" by washers and lock nuts 100, 100' that are known to those skilled in the art for securing ends of metal cables. Below the side wall upper overhand 46" is a curved surface 92 formed of curved polyethylene material. The curve of the surface 92 provides a retention guide for the upper tube 90 inserted through the upper guide channel 44 and also provides for energy absorption and impact force distribution along the side wall surfaces 46 and 42 upon a side impact 102' by a vehicle 102 against the upper tubes 90 and enclosed cables 98, 98' (see FIG. 18). The height of the upper guide channel 44 and the upper tube 90 inserted therethrough, is about 30 inches to about 31 inches from the barrier base 14. The height of the upper guide channel 44 is approximately the height of the bumper of a large-sized vehicle, to provide a plurality of surface elements such as overhang 46", upper tube 90, curved contoured surface 92, sloped segment 46 and angled segment 42, that are crushable and/or collapsible when struck by the vehicle's bumper. The destruction and/or compression of one or more upper surface elements (46", 90, 92, 46, and 42) provide a means for impact channeling and distribution of forces along the non-vertical surfaces and the vertical buttresses of the impacted side wall 32 while absorbing energy upon impact by a vehicle 102.

Through each lower channel 38, 38' of each barrier side wall 32, 32' barrier, a lower guide tube 94 is removably insertable through the respective side wall channels. The lower tube 94 is composed of a rigid material such as metal, or preferably a PVC pipe of about 3/16 inch wall thickness, and is removably insertable through the aligned lower guide channel 38 and lower holes 52*a*–52*e* in each buttress. The lower tube 94 is positioned along the lower guide channel 38 created by the overhang 40" of the middle wall segment 40. The energy-absorbing system 80 includes at least two lower cables 98", 98'" composed of high-strength stranded metal wire. The lower cables 98", 98'" are extended through the lower tubes 94 on each side wall 32, 32' of aligned nested barriers. The cable ends are threaded through the respective lower guides 86, 86' of the first end bridle member 82 and second end bridle member 82', and the cable ends are secured on the outer surface of the generally vertical support member 82" by washers and lock nuts 100, 100' that are known to those skilled in the art for securing ends of metal cables. Below the overhang 40" is the curved surface 96 formed of the polyethylene material of the barrier surface. The curved surface 96 provides a retention guide for the lower tube 94 inserted through the lower guide channels 38, 38' in each side wall 32, 32', and also provides for energy absorption and force distribution along the side wall surfaces 40 and 36 upon impact by a vehicle 102 (see FIG. 18). The height of the lower guide channel 38 and the lower tube 94 inserted therethrough, is about 16 inches to about 16.5 inches from the barrier base 14. The height of the lower guide channel 38 is approximately the height of the bumper of a small-sized vehicle, in order to provide a plurality of surface elements such as overhang 40", lower tube 94, curved surface 96, sloped segment 40 and angled segment 36, that are crushable and/or collapsible when struck by a vehicle. The destruction and/or compression of one or more lower surfaces and tube elements (40", 94, 96, 40, and 36) provides an impact channeling means that distributes impact forces along the plurality of non-vertical wall segments and the vertical buttresses of the impacted side wall for maximizing energy absorption by the side wall upon the impact by a vehicle 102.

An upper guide tube 90 is composed of a rigid material such as metal, or preferably a PVC material of about 3/16 inch thickness, and is removably insertable through the aligned upper guide channel 44 and upper holes 50*a*–50*e* in each buttress. The upper tube 90 is positioned along the upper guide channel 44 created by the overhang 46" of the upper wall segment 46. The energy-absorbing system 80 includes at least two upper cables 98, 98' composed of high-strength stranded metal wire. The upper cables 98', 98" are extended through the upper tubes 90 on each side wall 32, 32' of aligned nested barriers. The cable ends are threaded through the respective upper guides 84, 84' of the first end bridle member 82 and second end bridle member 82', and the cable ends are secured on the outer portion of each upper guide 84, 84' by washers and lock nuts 100, 100' that are known to those skilled in the art for securing ends of metal cables. Below the overhang 46" is the curved surface 92 formed of the polyethylene material of the barrier surface. The curved surface 92 provides a retention guide for the upper tube 90 inserted through the upper guide channel 44 and also provides for energy absorption and force distribution along the side wall surfaces 42 and 46 upon a side impact by a vehicle 102 (see FIG. 18). The height of the upper guide channel 44 and the upper tube 90 inserted therethrough, is preferably greater than the height, or is approximately the height, of the bumper of a large-sized vehicle, to provide a plurality of surface elements such as overhang 46", upper tube 90, curved surface 92, sloped segment 42 and upper wall segment 46, that are crushable and/or collapsible when struck by the vehicle's bumper. The destruction and/or compression of one or more lower surface or tube elements (46", 90, 92, 42, and 46) provides an impact channeling means that distributes impact forces along the plurality of non-vertical wall segments and the vertical buttresses of the side wall for maximizing energy absorption by each side wall segment upon the impact by a vehicle 102.

The individual members of the energy-absorbing system 80, when incorporated with the plurality of non-vertical wall segments and convoluted structure of one or both side walls 32, 32', provide a destructible side wall structure having tubes 90, 94 therein that are crushable and serve to provide energy-absorption upon impact. The energy-absorbing system 80 also absorbs and distributes the energy of the impacts while laterally channeling 102' a vehicle 102 between the lower guide channel 38 and the upper guide channel 44 of one side wall 32. By channeling 102' the vehicle 102 along the side walls of respective end-to-end nested barriers 110, protection is provided for workers occupying a work zone separated by the end-to-end nested barriers 110 from passing vehicles. Further, the supplemental energy-absorbing system 80 with respective upper cables 98, 98' and lower cables 98", 98'" inserted through respective upper guide channels 44, 44' and lower guide channels 38, 38' provide reinforcement of the appropriate barrier side wall facing a roadway where high speed vehicle impacts are common. An additional benefit includes the retention of a vehicle 102 on a roadway side of the nested barriers 110 after an impact against one or more barriers of the nested barriers 110, thereby minimizing the opportunity for the vehicle to flip over or to break through the junction of any two coupled ends (see FIG. 18). During the impact of a speeding vehicle with one or more aligned barriers, the impacted barriers may lose water-tight integrity with resulting loss of fluids from the interior cavity 12'. One goal of the protection barrier system 10 and nested barriers 110 is achieved when the fluid enhanced mass of one or more water-filled barriers absorb the impact of a vehicle with minimal lateral movement of the nested barriers 110. The energy-absorbing system 80 including one or more of cables 98–98'" extended through guide channels 38, 44 of nested barriers 110, and tubes 90, 94 are removably attachable through the first side wall 32 and/or the like-configured second side wall 32' of the nested barriers 110.

Each like-configured barrier 12 is produced by a method of manufacture including a forming process utilizing heated polyethylene material injected into an enclosing mold. The enclosing mold can include a plurality of mold segments such as side wall molds and end wall molds that are assembled together to form a barrier shell having an internal chamber upon injection of polyethylene material into the enclosing mold. A step of forming includes positioning the perimeter of a first side wall mold proximal to the perimeter of the second side wall mold to form a part line 30. Each side wall mold includes external wall segments faced outwardly and includes the interior surfaces of each wall segment facing inwardly. During about the same time sequence, two like-configured end segment molds are positioned proximal to the opposed ends of the two side wall molds positioned with interior surfaces facing inwardly. A step of injecting heated polyethylene material includes injecting the polyethylene material into each side wall mold and each end wall mold, thereby forming a barrier shell having opposed side walls and opposed end walls, each respective wall thickness being about 5/16 inches. The step of forming can include a step of providing two side wall molds that are like-configured molds having a plurality of non-vertical wall segments faced outwardly (see FIG. 12). A step of bonding provides side walls 32, 32' bonded together along part line 30 to produce a barrier 12 having a hollow chamber 12' therein. The method of manufacture further includes a step of joining two like-configured ends 54, 54' to the opposed ends of the bonded side walls along part lines 72 and 72'. A molding process such as a continuous rotational molding process line and associated equipment known to those skilled in the art is preferred to produce high-strength, resilient and water-tight bonds and junctions along part lines 30, 72 and 72' of each barrier 12. An overall length of the barrier 12 is about seven feet, six inches. The step of providing like-configured side wall molds can additionally include providing non-vertical wall segments of the side wall molds having vertical buttresses extended outwardly in a spaced apart orientation from each wall segment. An alternative method includes a step of providing side wall molds having either one wall segment, or both non-vertical wall segments of the side wall molds lacking any vertical buttresses. An alternative step of providing can include providing one side wall mold having a plurality of non-vertical wall segments thereon, and providing a second side wall mold having a generally flat vertically oriented wall surface (see FIG. 22).

As illustrated in FIG. 19, an alternative embodiment of the barrier includes a barrier 210 having an OAL of about thirteen feet, three inches, and a nested length of about twelve feet, six inches. The barrier 210 is formed by a method of manufacture having at least one step of combining along junction seam 272', two identical side wall sections 32, 32 aligned end-to-end to form lengths of side walls 232, 232'. The second side wall section 232' is bonded to first side wall 232 along junction seams 230, 230' along top surface 222 (see FIG. 19). The method of manufacture includes a step of joining identical ends 254, 254' along respective junction seams 272 and 272" to the opposed ends of the bonded side wall sections 232, 232'. Barrier 210 includes a plurality of vertical buttresses 248*a*–248*i* formed into each side wall 232, 232' in spaced apart intervals. The plurality of vertical buttresses 248*a*–248*i* provide additional rigidity for each side wall 232, 232' and provide for additional energy-absorbing capabilities along each side wall as a vehicle impacts one or more side wall portions while being channeled along the side walls of aligned barriers 210 with resulting destruction of the vertical buttresses contacted by the vehicle to slow and contain the vehicle.

As illustrated in FIG. 20, an alternative embodiment includes a barrier 310 having an OAL of about nineteen feet, zero inches, and a nested length of about eighteen feet, four inches. The barrier 310 is formed by a method of manufacture including a step of combining like configured side walls 332, 332', 332" aligned end-to-end to form lengths combined along junction seams 372' and 372". A step of bonding includes bonding along junction seams 330, 330', 330" each of the side walls combined end-to-end to form a barrier shell extended from junction seam 372 to seam 372". A step of joining includes joining end wall segment 354 along junction seam 372, and joining end wall segment 354' along junction seam 372" to form the barrier 310 of an extended length of about nineteen feet, zero inches. Barrier 310 includes a plurality of vertical buttresses 348*a*–348*m* formed into each side wall 332, 332' in spaced apart intervals. The plurality of vertical buttresses 348*a*–348*m* provide additional rigidity for each side wall of the barrier 310 to provide for additional energy-absorbing capabilities along each side wall when a vehicle impacts one or more portions of the side walls. The vehicle is channeled along the impacted side walls with resulting destruction of vertical buttresses contacted by the vehicle to slow and contain the vehicle.

An alternative method of manufacture of barrier 310 includes forming units of bonded side wall units 332, 332', 332" having opposed like-configured side walls 32, 32' bonded together. A step of bonding for unit 332 includes bonding two identical side walls 32, 32' along junction seam 330 along top surface 322 (see FIG. 20). A second step of bonding for unit 332' includes bonding two identical side walls 32, 32 along junction seam 330' to form unit 332'. A third step of bonding for unit 332" includes bonding two identical side walls 32, 32 along junction seam 330" to form unit 332". A first step of combining includes aligning and bonding first unit 332 to second unit 332' along junction seam 372' (see FIG. 20). A second step of combining includes aligning and bonding first and second unit 332/332' to third unit 332" along junction seam 372". A step of joining includes joining identical ends 354, 354' to opposed ends of the barrier shell 332, 332', 332". First end 354 is bonded at junction seam 372 to a first end of unit 332, and the second end 354' is bonded at junction seam 372" to the second end of unit 332". Barrier 310 includes a plurality of vertical buttresses 348*a*–348*m* formed into each side wall 332, 332' in spaced apart intervals. The plurality of vertical buttresses 348*a*–348*m* provide additional rigidity for each side wall 332, 332' and provide for additional energy-absorbing capabilities along each side wall as a vehicle's bumper impacts one or more portions of the side walls and moves along the side walls with resulting destruction of respective vertical buttresses contacted by the vehicle to slow and contain the vehicle.

An alternative embodiment of a protective barrier 410 is illustrated in FIG. 22. An alternative method of manufacture includes a step of joining a flat side second wall 430 to a first side wall 432 having a plurality of non-vertical segments (see FIG. 22), along with a step of joining end-to-end two or more joined flat side second wall 430 and first side wall 432, and the steps of bonding identical ends 54, 54' to opposed ends of the joined side wall sections 430 and 432. The protective barrier 410 can be utilized at a racetrack to provide a "soft wall" section along portions of the restraining barrier wall of the racetrack. The flat side second wall 430 is positioned against the permanently installed restraining barrier wall, with the first side wall 432 protruding inwardly toward the rode surface. The first side wall 432 can include a plurality of spaced apart, vertically oriented buttresses, or can be utilized without buttresses (see FIG. 17). For an embodiment of the first side wall 432 lacking buttresses, and having an upper guide channel 434 and a lower guide channel 436, the channels are spaced apart, horizontally oriented and are each inwardly curved. A plurality of spring clips 440, 440', 440", 440'" are disposed in spaced apart orientation (see FIG. 17), in order to retain an upper tube 438 in upper guide channel 434 and a lower tube 438' in lower guide channel 436. Depending on the required level of impact resistance, each upper and lower guide channel 434, 436, with or without respective tubes 438, 438', can have an upper cable 98, and/or a lower cable 98" extended through the channels and retained therein during assembly of end-to-end aligned barriers by the plurality of springs clips 440 positioned along the first side wall 432. The protective barrier 410 provides an additional level of protection for the driver of the race vehicle by allowing the race vehicle, when traveling out of control at high speeds, to impact a "soft wall" that is designed to absorb energy and distribute the force of impact along the end-to-end joined side walls 432. Additional uses for the protective barrier 410 include use as a single barrier unit or as a plurality of nested barriers aligned end-to-end along public roads that are temporarily utilized during race events. The protective barrier 410 can be positioned adjacent public landmarks and existing road barriers, and/or positioned for crowd control during along any racing event or parade event requiring enhanced crowd security.

Those skilled in the art will recognize that the protection barrier system is utilized as a safety barrier in a multitude of scenarios including: a pedestrian barrier and parking area barrier when the barrier is manufactured as a thin-walled, light weight protection barrier; a readily movable empty barrier having rigid polyethylene walls for use along low speed roadways; an interlocking barrier that is easily filled with liquid or granular ballast in medium speed roadways and/or as building security barriers; and as interlocking barriers filled with liquid or granular ballast and having a plurality of tubes and cables extended through the interconnected barriers for high speed roadways or for high security military installations. In addition, an alternative embodiment having non-identical side walls sized and/or shaped differently can be utilized as energy-absorbing barriers positioned against rigid concrete or metal walls surrounding a race venue such as a go-cart track, oval race track, or a high-speed race track having multiple turns. Further, the protection barrier system is utilized as an intruder protection barrier around buildings and facilities having national security value in order to thwart or deter terrorist attacks utilizing vehicles, without departing from the spirit and scope of the present invention.

From the foregoing description, it will be recognized by those skilled in the art that a protection barrier system is disclosed that provides a portable barrier having significant energy-absorbing and energy-deflecting capabilities. These capabilities are due to numerous innovative features of the multi-angled side walls and the opposed ends having identical interconnection means for efficient end-to-end connection of a plurality of like-configured barriers. Each barrier can be produced in at least three barrier lengths for various uses. The barrier lengths are generally light-weight barriers having water-tight hollow chambers therein. The energy-absorbing and energy-deflecting capabilities of the barrier system is significantly increased by the additional of the components of the supplemental energy-absorbing system 80 as discussed herein. An additional embodiment for increasing the energy-absorbing and energy-deflecting capabilities of the barrier system includes combining one barrier or a plurality of barriers of the first barrier length, which are readily interdisposed by interconnecting with one or more barriers of the second barrier length, or by interconnecting with one or more barriers of the third barrier length. The selection of an appropriate length and the combination of different lengths of barriers provides a significant number of options for safety engineers and installing workers tasked with construction of a protection barrier system tailored to each unique roadway project and building construction project requiring protection of workers from moving vehicles.

While the present invention has been illustrated by description of several embodiments and while the illustrative embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details of the protection barrier system including the representative apparatus, alternative embodiments, and method of manufacture, and the illustrative examples shown and described. Accordingly, departures may be made from such details without departing from the spirit or scope of applicants' general inventive concept.

We claim:

1. A protection barrier comprising:

an elongated barrier defining a chamber therein, said barrier having first and second side walls, a base and a top surface, each of said first and second side walls including a plurality of non-vertical wall segments disposed thereon;

a guide channel being inwardly curved and carried by each of said first and second side walls, said guide channel being positioned in horizontal alignment with similar sized guide channels on like-configured barriers; and a coupling disposed on each opposed first and second end of said barrier, said coupling for connecting juxtaposed end-to-end arrangement of like-configured barriers, said coupling including:

a tongue extended from each opposed first and second end of said barrier, said tongue extending vertically between said base and said too surface of said barrier, said tongue extended from an off-center portion of each end;

a groove indentation in each opposed first and second end and extending vertically between said base and said top surface of said barrier, said groove having a mirror-image configuration of said tongue, said groove and tongue having one continuous surface; and each opposed first and second end of said barrier having beveled corners providing for pivotable movement of said tongue of a first barrier end when releasably inserted within a second groove indentation of either end of a like-configured second barrier thereby forming an end-to-end aligned and nesting relationship of a plurality of like-configured barriers.

2. The protection barrier of claim 1 wherein said guide channel including:

said guide channel bounded horizontal by two adjacent wall segments of a plurality of non-vertical wall segments on each of said first and second side walls;

means for guiding positioned vertically on each of said first and second side walls proximal of each opposed first and second end of said barrier, said means for guiding having an inwardly curved portion disposed within said guide channel; and a tube removably extended through said guide channel, said tube retained within said guide channel by said inwardly curved portion of said means for guiding;

whereby upon an impact of a vehicle with one of said first or second side walls, said tube and guide channel are impacted with resulting destruction of said tube within said guide channel and with resulting distribution of impact energy along said guide channel and said two adjacent wall segments of said first and second side walls.

3. The protection barrier of claim 1 further comprising:

said chamber is extended in said barrier between said base, said top surface and said first and second ends;

said first and second side walls each including said plurality of non-vertical wall segments being disposed between said base and said top surface;

said guide channel including an upper guide channel aligned parallel with a lower guide channel, said upper and lower guide channels are each inwardly curved and spaced apart horizontally between an upper wall sloped segment and a lower wall sloped segment of said plurality of non-vertical wall segments;

a plurality of buttresses positioned vertically at spaced apart locations along said first and second side walls; each of said plurality of buttresses having an upper opening and a lower opening therethrough, said upper opening of each buttress being aligned with said upper guide channel, said lower opening of each buttress being aligned with said lower guide channel;

a first channel edge extended horizontally along said upper wall sloped segment, said first channel edge providing an upper boundary of said inwardly curved upper guide channel;

a second channel edge extended horizontally along said lower wall sloped segment, said second channel edge providing an upper boundary of said inwardly curved lower guide channel;

said means for guiding including a plurality of spring clips disposed in spaced apart vertical orientation to extend between said inwardly curved upper guide channel and said inwardly curved lower guide channel on each of said first and second side walls proximal of each opposed first and second end of said barrier, each of said spring clips having upper and lower inwardly curved portions disposed within respective upper and lower guide channels; and at least one cable extended horizontally within one of said upper guide channel and said lower guide channel, said at least one cable retained against respective spring clips upper or lower inwardly curved portions within one of said upper guide channel and said lower guide channel, said at least one cable extended between respective aligned channels of end-to-end aligned and nested like-configured barriers.

4. The protection barrier of claim 3 wherein said upper and lower guide channels including:

an upper tube removably extended through said upper guide channel, said upper tube being retained within said upper guide channel by said upper curved portion of each spring clip, said upper tube having an upper cable inserted horizontally therein for retention within said inwardly curved upper guide channel; and a lower tube removably extended through said lower guide channel, said lower tube having a lower cable extended horizontally therein for retention below said second channel edge and within said inwardly curved lower guide channel;

whereby upon an impact of a vehicle with one of said first or second side walls, said upper tube and said lower tube are impacted with resulting destruction of said upper tube and said lower tube with resulting distribution of impact energy along said upper guide channel and said lower guide channel of said plurality of non-vertical wall segments.

5. The protection barrier of claim 1 wherein said barrier is composed of polyethylene material of sufficient density for said barrier to be substantially rigid, said barrier having an inlet for receipt of ballast into said chamber, said inlet disposed through said top surface, and an outlet for release of ballast from said interior chamber, said outlet disposed proximal of said base, whereby said chamber is filled with ballast during stationary use to facilitate energy-absorbing and retention in an upright position upon being impacted by a vehicle.

6. The protection barrier em of claim 4, further including:

a first end member disposed proximal one end of the non-nested barrier ends of the plurality of like-configured nested barriers, said end member having first and second side walls aligned with each respective side wall of the adjacent nested barrier, said end member having an outer curved end and an inwardly arcuate end including:

a tongue extended from said arcuate end, said tongue extending vertically along said arcuate end; and a groove indentation in said arcuate end, said groove indentation extending vertically along said arcuate end;

whereby said tongue and said groove indentation of said first end member are disposed to mate with respective groove indentation and tongue of one of the non-nested barrier ends of the plurality of like-configured nested barriers;

said first and second side walls including a plurality of non-vertical wall segments disposed at heights comparable to said first and second side walls of the plurality of like-configured nested barriers;

a like-configured second end member disposed proximal an opposed non-nested barrier end of the plurality of like-configured nested barriers;

a spring clip disposed on said first and second side walls of each first and second end member, said spring clips being positioned at heights comparable to said first and second guide channels on adjacently nested barriers, each of said sprint clips having upper and lower inwardly curved portions through which respective upper and lower cables are retained in encircling relationship around said first and second end members, and said upper and lower cables are disposed to extend from said first end member to said like-configured second end member, said upper and lower cables extended along each first and second side wall of the plurality of like-configured nested barriers positioned end-to-end between said first and second end members.

* * * * *